US008532532B2

(12) United States Patent
Shimura et al.

(10) Patent No.: US 8,532,532 B2
(45) Date of Patent: Sep. 10, 2013

(54) IMAGE FORMING APPARATUS HAVING A CONTROLLABLE DRIVE COUPLING

(75) Inventors: Masaru Shimura, Numazu (JP); Michio Uchida, Susono (JP); Ken Nakagawa, Mishima (JP); Seiji Saito, Mishima (JP); Kenji Kanari, Numazu (JP); Takamitsu Soda, Mishima (JP); Takaaki Akamatsu, Suntou-gun (JP); Kazuhiro Doda, Yokohama (JP); Takashi Shimada, Moriguchi (JP); Shuichi Tetsuno, Numazu (JP); Shigeru Hoashi, Numazu (JP); Tomoya Kuruma, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/226,876

(22) Filed: Sep. 7, 2011

(65) Prior Publication Data

US 2011/0318035 A1 Dec. 29, 2011

Related U.S. Application Data

(63) Continuation of application No. 12/415,822, filed on Mar. 31, 2009, now Pat. No. 8,036,574.

(30) Foreign Application Priority Data

Apr. 1, 2008 (JP) ..... 2008-095125
Mar. 6, 2009 (JP) ..... 2009-053711

(51) Int. Cl.
*G03G 15/00* (2006.01)
*G03G 15/01* (2006.01)

(52) U.S. Cl.
USPC ..... 399/167; 399/302; 399/308; 399/314

(58) Field of Classification Search
USPC ..... 399/167, 310, 312, 314
See application file for complete search history.

(56) References Cited

U.S. PATENT DOCUMENTS 3,606,532 A * 9/1971 Shelffo et al. ..... 399/76
5,845,174 A * 12/1998 Yasui et al. ..... 399/101

(Continued)

FOREIGN PATENT DOCUMENTS

JP 08-171328 A 7/1996
JP 2002-182537 A 6/2002

(Continued)

OTHER PUBLICATIONS

JPO Notification of Final Refusal for JPO Application 2009-053711 dated Sep. 13, 2010.*

(Continued)

*Primary Examiner* — Walter L Lindsay, Jr.
*Assistant Examiner* — David Bolduc
(74) *Attorney, Agent, or Firm* — Canon USA Inc IP Division

(57) ABSTRACT

An image forming apparatus for forming image on a recording medium includes a photosensitive member, a motor, a belt, and a drive member to rotate the belt, the drive member including a driven coupling. The apparatus also includes a drive coupling to rotate by a driving force generated by the motor, the drive coupling being movable in an axial direction to take an engagement position at which the driving force is transmittable to the driven coupling, and a release position. The apparatus further includes a transfer member to transfer a toner image onto the recording medium or the belt, a voltage application unit to apply a voltage to the transfer member, and a control unit to cause the voltage application unit to apply the voltage to the transfer member after the drive coupling moves to the engagement position and the driving force is transmitted to the driven coupling.

20 Claims, 26 Drawing Sheets

(56) References Cited

U.S. PATENT DOCUMENTS

| | | | | |
|---|---|---|---|---|
| 6,122,474 | A * | 9/2000 | Asakura et al. | 399/297 |
| 7,085,516 | B2 * | 8/2006 | Kawai et al. | 399/111 |
| 7,167,657 | B2 * | 1/2007 | Inoue et al. | 399/44 |
| 8,036,574 | B2 * | 10/2011 | Shimura et al. | 399/167 |
| 2002/0057928 | A1 * | 5/2002 | Yasumoto et al. | 399/167 |
| 2002/0098013 | A1 * | 7/2002 | Kamimura | 399/167 |
| 2002/0150404 | A1 * | 10/2002 | Matsuzaka et al. | 399/111 |
| 2003/0053823 | A1 * | 3/2003 | Cho et al. | 399/167 |
| 2003/0223784 | A1 * | 12/2003 | Yamanaka et al. | 399/299 |
| 2005/0089345 | A1 * | 4/2005 | Yasumoto et al. | 399/167 |
| 2005/0134668 | A1 * | 6/2005 | Takahashi et al. | 347/156 |
| 2006/0008287 | A1 * | 1/2006 | Noda et al. | 399/90 |
| 2006/0204263 | A1 * | 9/2006 | Watanabe | 399/66 |
| 2008/0145076 | A1 * | 6/2008 | Mochizuki | 399/55 |
| 2008/0170880 | A1 * | 7/2008 | Hashimoto | 399/106 |
| 2008/0253812 | A1 * | 10/2008 | Pearce et al. | 399/307 |
| 2009/0123181 | A1 * | 5/2009 | Ito et al. | 399/167 |

FOREIGN PATENT DOCUMENTS

| | | | |
|---|---|---|---|
| JP | 2002182537 | A * | 6/2002 |
| JP | 2004-093987 | A | 3/2004 |
| JP | 2004126030 | A * | 4/2004 |
| JP | 2005-331548 | A | 12/2005 |
| JP | 2005331548 | A * | 12/2005 |
| JP | 2006-011317 | A | 1/2006 |
| JP | 2006-098893 | A | 4/2006 |
| JP | 2007-093924 | A | 4/2007 |

OTHER PUBLICATIONS

Machine translation of JP 2002182537 pub date Jun. 2002.*

* cited by examiner

IMAGE FORMING APPARATUS HAVING A CONTROLLABLE DRIVE COUPLING

CROSS REFERENCE TO RELATED APPLICATIONS

This application is a Continuation of U.S. patent application Ser. No. 12/415,822, filed Mar. 31, 2009, which claims priority to Japanese Patent Application No. 2009-053711, filed Mar. 6, 2009, and Japanese Patent Application No. 2008-095125, filed Apr. 1, 2008, each of which are hereby incorporated by reference herein in their entireties.

BACKGROUND OF THE INVENTION

1. Field of the Invention

The present invention generally relates to an image forming apparatus using an electrophotographic recording method, such as a laser printer, a copying machine, a facsimile machine, or the like.

2. Description of the Related Art

Conventionally, image forming apparatuses using an electrophotographic method include a plurality of photosensitive drums that contribute to enhancing the speed of image forming. Various types of methods have been proposed for sequentially transferring toner images having different colors onto a recording material conveyed by an intermediate transfer belt or a conveying belt.

In such an image forming apparatus, a cartridge including a photosensitive drum or an intermediate transfer unit including an intermediate transfer belt is in a removable configuration. A driving force of a motor that is a drive unit of the main body of the image forming apparatus is transmitted to the photosensitive drum or a drive roller that is a drive member for the intermediate transfer belt or the conveying belt via a coupling unit. The coupling unit includes a first coupling provided on the side of the main body and a second coupling provided on the side of the photosensitive drum or the drive roller. The first coupling and the second coupling are configured such that a disconnected state as well as a connected state can be assumed.

When the first coupling and the second coupling are connected, the surface speed of the photosensitive drum or the belt is typically proportional to the speed of the motor. However, if the motor is started when the state of the couplings is changing from the disconnected state to the connected state, the photosensitive drum or the belt does not rotate (i.e., the surface speed is zero) even though the motor is activated. If this state continues, the surface of the photosensitive drum or the belt may be damaged, which may lead to image quality issues.

In these circumstances, Japanese Patent Application Laid-Open No. 2002-182537 discusses a method in which a low motor speed, compared to the speed that is used when an image is formed, is used until one of the couplings, which is used for transmitting a driving force generated by a motor to a photosensitive drum, is connected to the other coupling. In other words, the motor speed will be low during the connection time of the couplings. This time is based on the couplings that take the longest time in the connection.

SUMMARY OF THE INVENTION

According to an aspect of the present invention, an image forming apparatus for forming an image on a recording medium includes a photosensitive member, a motor, a belt configured to contact the photosensitive member, a drive member configured to rotate the belt and including a driven coupling, a drive coupling configured to rotate by a driving force generated by the motor, the drive coupling being movable in an axial direction such that the drive coupling can take an engagement position, at which the driving force is transmittable to the driven coupling while in engagement with the driven coupling, and a release position, at which the engagement with the driven coupling is released, a transfer member configured to transfer a toner image formed on the photosensitive member onto the recording medium carried on the belt or onto the belt, a voltage application unit configured to apply a voltage to the transfer member, and a control unit configured to execute control for causing the voltage application unit to apply the voltage to the transfer member after the drive coupling moves to the engagement position by drive of the motor and the driving force generated by the motor is transmitted to the driven coupling.

According to another aspect of the present invention, an image forming apparatus for forming an image on a recording medium includes a photosensitive member, a charging member configured to charge the photosensitive member, a motor, a belt configured to contact the photosensitive member, a drive member configured to rotate the belt and including a driven coupling, a drive coupling configured to rotate by a driving force generated by the motor, the drive coupling being movable in an axial direction such that the drive coupling can take an engagement position, at which the driving force is transmittable to the driven coupling while in engagement with the driven coupling, and a release position, at which the engagement with the driven coupling is released, a voltage application unit configured to apply a voltage to the charging member, and a control unit configured to execute control for causing the voltage application unit to apply the voltage to the charging member such that a portion charged by the charging member on the photosensitive member comes to a contact position where the portion contacts the belt after the drive coupling moves to the engagement position by drive of the motor and the driving force generated by the motor is transmitted to the driven coupling.

According to yet another aspect of the present invention, an image forming apparatus for forming an image on a recording medium includes a motor, a main-body coupling configured to rotate by a driving force generated by the motor, a process cartridge removable from a main body of the image forming apparatus and including a photosensitive drum and a drum coupling configured to transmit the driving force to the photosensitive drum by engaging with the main-body coupling at a predetermined phase angle when the process cartridge is mounted into the main body, a belt configured to contact the photosensitive member, a drive member configured to rotate the belt and including a driven coupling, a drive coupling configured to rotate by the driving force generated by the motor, the drive coupling being movable in an axial direction such that the drive coupling can take an engagement position, at which the driving force is transmittable to the driven coupling while in engagement with the driven coupling at a phase angle larger than the predetermined phase angle, and a release position, at which the engagement with the driven coupling is released, a transfer member configured to transfer a toner image formed on the photosensitive member onto the recording medium carried on the belt or onto the belt, a voltage application unit configured to apply a voltage to the transfer member, and a control unit configured to execute control for causing the voltage application unit to apply the voltage to the transfer member after the drive coupling moves to the engagement position by drive of the motor and the driving force generated by the motor is transmitted to the driven coupling.

According to yet another aspect of the present invention, an image forming apparatus for forming an image on a recording medium includes a motor, a main-body coupling configured to rotate by a driving force generated by the motor, a process cartridge removable from a main body of the image forming apparatus and including a photosensitive drum, a charging member configured to charge the photosensitive drum, and a drum coupling configured to transmit the driving force to the photosensitive drum by engaging with the main-body coupling at a predetermined phase angle when the process cartridge is mounted into the main body, a belt configured to contact the photosensitive member, a drive member configured to rotate the belt and including a driven coupling, a drive coupling configured to rotate by the driving force generated by the motor, the drive coupling being movable in an axial direction such that the drive coupling can take an engagement position, at which the driving force is transmittable to the driven coupling while in engagement with the driven coupling at a phase angle larger than the predetermined phase angle, and a release position, at which the engagement with the driven coupling is released, a voltage application unit configured to apply a voltage to the charging member, and a control unit configured to execute control for causing the voltage application unit to apply the voltage to the charging member such that a portion charged by the charging member on the photosensitive member comes to a contact position where the portion contacts the belt after the drive coupling moves to the engagement position by drive of the motor and the driving force generated by the motor is transmitted to the driven coupling.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
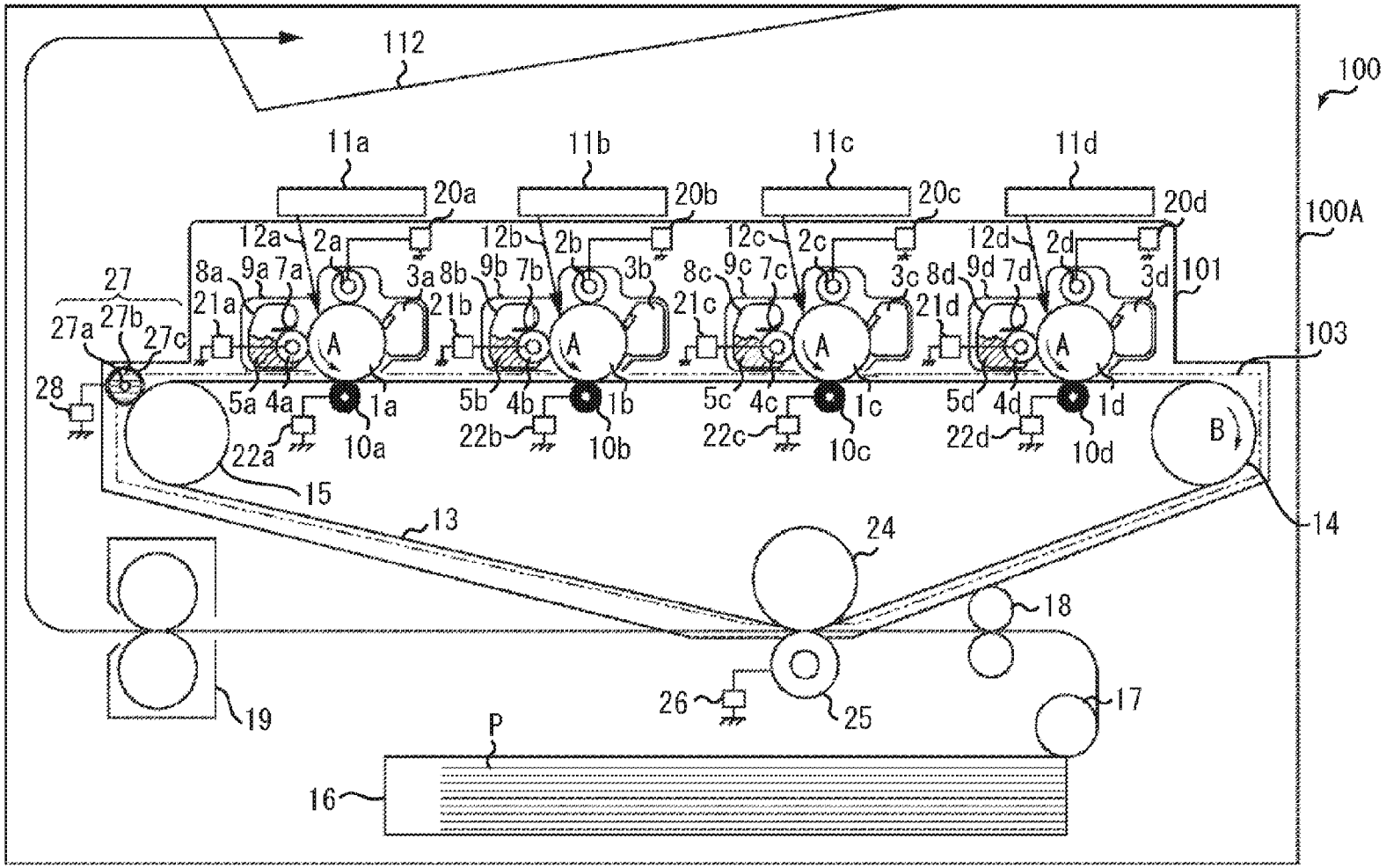
FIG. 1 illustrates an example of a configuration of an image forming apparatus according to a first exemplary embodiment of the present invention.

FIG. 1 illustrates an example of a configuration of an image forming apparatus according to a first exemplary embodiment of the present invention.

According to this embodiment, an image forming apparatus 100 includes four process cartridges 9*a*, 9*b*, 9*c*, and 9*d*, which are removable from an apparatus main body 100A. The process cartridges 9*a* to 9*d* are used for forming images of yellow (Y), magenta (M), cyan (C), and black (K), respectively.

The process cartridge 9*a* to 9*d* is an all-in-one cartridge including an organic photosensitive (OPC) drum 1*a* to 1*d* as a photosensitive member, a charging roller 2*a* to 2*d* as a charging member, a cleaning unit 3*a* to 3*d* used for removing residual toner on the photosensitive drum 1*a* to 1*d*, and a developing unit 8*a* to 8*d*. The developing unit 8*a* to 8*d* includes a developing sleeve 4*a* to 4*d*, nonmagnetic one-component developer (toner) 5*a* to 5*d*, and a developer blade 7*a* to 7*d*. The process cartridges 9*b* to 9*d* have a similar configuration as the process cartridge 9*a* except that they include developers 5*b* to 5*d* having respective different colors.

Exposure units 11*a* to 11*d* are provided above the process cartridges 9*a* to 9*d*. Each of the exposure units 11*a* to 11*d* includes a scanner unit configured to direct laser beams onto a polygonal mirror for scanning or a light emitting diode (LED) array. Scanning beams 12*a* to 12*d*, which are modulated by image signals, are directed on the photosensitive drums 1*a* to 1*d*, respectively.

Further, an intermediate transfer belt 13, which contacts all of the four photosensitive drums 1*a* to 1*d*, is arranged under the process cartridges 9*a* to 9*d*. The intermediate transfer belt 13 is stretched and supported by a secondary transfer counter roller 24, a drive roller 14 as a drive member, and a tension roller 15. These three rollers provide appropriate tension to the intermediate transfer belt 13. According to drive of the drive roller 14, the intermediate transfer belt 13 moves in the direction indicated by the arrow B, which is the same as the movement direction indicated by the arrow A of the photosensitive drums 1*a* to 1*d*, at a speed approximately the same as that of the drive roller 14.

According to the present exemplary embodiment, the intermediate transfer belt 13 is a 100 micrometer-thick polyvinylidene fluoride (PVDF) belt having a volume resistivity of $10^{10}$ ohm cm. The drive roller 14 as the stretching member is a 20-mm diameter roller with an aluminum cored bar coated with a 1.0 mm-thick layer of ethylene propylene diene M-class (EPDM) rubber which has an electric resistance of $10^4$ ohms and in which carbon is distributed as an electroconductive agent. The tension roller 15 as the stretching member is a 20-mm diameter aluminum metal bar and provides a tension of 19.6 N for each one side and 39.2 N in total. The secondary transfer counter roller 24 as the stretching member is a 20-mm diameter roller with an aluminum cored bar coated with a 1.5 mm-thick layer of EPDM rubber which has an electric resistance of $10^4$ ohms and in which carbon is distributed as an electroconductive agent.

Further, primary transfer rollers 10*a* to 10*d* as primary transfer members are arranged opposite the photosensitive drums 1*a*-1*d* with the intermediate transfer belt 13 in between. According to the present exemplary embodiment, each of the primary transfer rollers 10*a* to 10*d* is a roller having an outside diameter of 14 mm and includes a 6-mm-diameter nickel plated steel bar coated with a 4-mm thick elastic layer of nitrile butadiene rubber (NBR) foam sponge having an electric resistance of $10^7$ ohms.

Further, the apparatus main body 100A includes a charge bias power supply unit 20*a* to 20*d* as a voltage supply unit for supplying a bias voltage to the charging roller 2*a* to 2*d*, a developing bias power supply unit 21*a* to 21*d* as a voltage supply unit for supplying a bias voltage to the developing sleeve 4*a* to 4*d*, and a primary transfer bias power supply unit 22*a* to 22*d* as a voltage supply unit for supplying a bias voltage to the primary transfer roller 10*a*. The intermediate transfer belt 13, the drive roller 14, the tension roller 15, the secondary transfer counter roller 24, the primary transfer rollers 10*a*-10*d*, and a toner charge unit 27 constitute an all-in-one belt unit 103. The belt unit 103 is removably mounted in the apparatus main body 100A.

Next, an example of an image forming operation will be described. When the image forming operation is started, the photosensitive drums 1*a* to 1*d* and the intermediate transfer belt 13 start to rotate in the direction indicated by the arrows A and B at a predetermined process speed. By the power supplied by the charge bias power supply unit 20*a*, the charging roller 2*a* charges the photosensitive drum 1*a* to a uniform negative polarity at its surface. Then, an electrostatic latent image corresponding to image information is formed on the photosensitive drum 1*a* by the scanning beam 12*a* emitted from the exposure unit 11*a*. According to the present exemplary embodiment, a voltage of −1000 V is applied to the charging roller 2*a* by the charge bias power supply unit 20*a* so that the surface of the photosensitive drum 1*a* is electrically charged to −500 V.

The toner 5*a* in the developing unit 8*a* is coated onto the developing sleeve 4*a*. The toner 5*a* on the developing sleeve 4 is regulated to have a predetermined thickness by the developer blade 7*a*. A predetermined bias voltage is supplied to the developing sleeve 4*a* from the developing bias power supply unit 21*a*. When the electrostatic latent image formed on the photosensitive drum 1*a* reaches the developing sleeve 4*a* by the rotation of the photosensitive drum 1*a*, the electrostatic latent image is made visible with the negatively chargeable toner. Accordingly, a toner image of the first color (yellow (Y), in this embodiment) is formed on the photosensitive drum 1*a*. Since the configuration of the process cartridges 9*b*, 9*c*, and 9*d* is similar to that of the process cartridge 9*a*, their description will be omitted.

An electrostatic image is formed on each of the photosensitive drums 1*a* to 1*d* according to exposure by the exposure units 11*a* to 11*d* while a controller as a control unit outputs a writing signal which is delayed depending on each primary transfer position of the corresponding color. Then, by each of the developing units 8*a* to 8*d*, an electrostatic latent image is developed into a toner image. Further, a bias voltage of a polarity opposite to a charge polarity of the toner is applied to the primary transfer rollers 10*a* to 10*d* by the primary transfer bias power supply units 22*a* to 22*d*, respectively. Through the above-described processes, toner images can be successively transferred onto the intermediate transfer belt 13, and a multiple superimposed image can be formed on the intermediate transfer belt 13.

Subsequently, in synchronization with the image formation, a transfer material P stacked in a transfer material cassette 16 is picked up by a feeding roller 17 and conveyed to registration rollers 18. Then, the transfer material P is further conveyed to an abutment portion which is formed between the intermediate transfer belt 13 and a secondary transfer roller 25 in synchronization with the toner image formed on the intermediate transfer belt 13. Subsequently, a bias voltage opposite in polarity to the toner is applied to the secondary transfer roller 25 by a secondary transfer bias power supply unit 26, so that the four-color superimposed images carried on the intermediate transfer belt 13 are simultaneously secondary-transferred onto the transfer material P. According to this exemplary embodiment, the secondary transfer roller 25 is a roller having an outside diameter of 18 mm and includes a 8-mm-diameter nickel plated steel bar coated with a 5-mm thick elastic layer of NBR foam (sponge) having an electric resistance of $10^8$ ohms.

On the other hand, after the secondary transfer is completed, residual toner remaining on the intermediate transfer belt 13 is positively charged by the toner charge unit 27 which abuts the intermediate transfer belt 13. Then, by the primary transfer process in which a bias voltage of positive polarity is applied to each of the primary transfer members 10*a* to 10*d*, the residual toner is transferred onto the photosensitive drums 1*a* to 1*d* from the surface of the intermediate transfer belt 13 and collected by the cleaning units 3*a* to 3*d*.

According to the image forming apparatus of the present exemplary embodiment, a roller member including a 6-mm-diameter nickel plated steel bar 27*a* coated with a foam sponge layer 27*b* of EPDM rubber in which carbon black is distributed, and with a protective layer 27*c* made of water-soluble nylon as a surface layer, is used as the toner charge unit 27. Further, the toner charge unit 27 is connected to a toner charge bias power supply unit 28. In order to positively charge the untransferred residual toner, a direct voltage of 1 kV superposed on an alternating voltage of 2.5 kVpp is applied to the toner charge unit 27 by the toner charge bias power supply unit 28.

The transfer material P onto which the secondary-transfer-completed toner image is transferred is conveyed to a fixing unit 19. After the toner image is fixed by the fixing unit 19, the transfer material P is discharged to a discharging portion 112.

Figure 2:
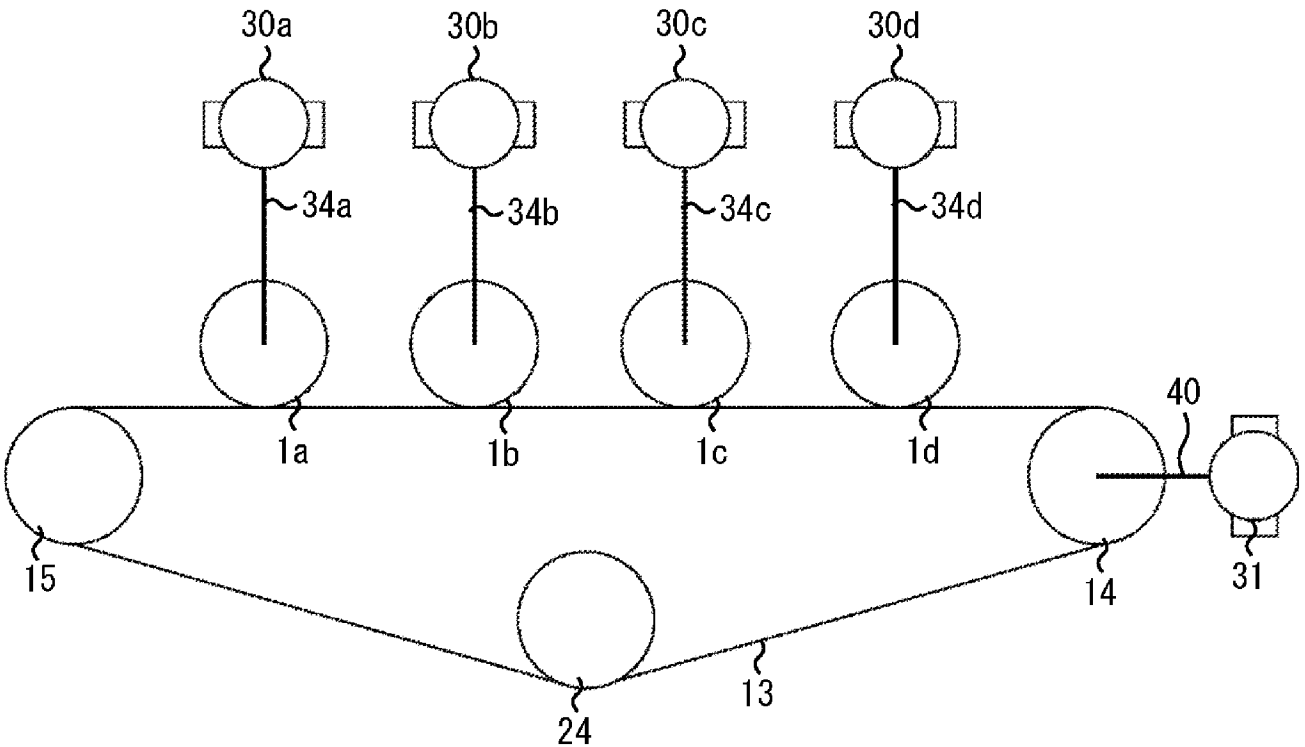
FIG. 2 illustrates an example of a drive transmission system of photosensitive drums and an intermediate transfer belt used in the first exemplary embodiment of the present invention.

As illustrated in the example shown in FIG. 2, a driving force is transmitted from motors 30*a* to 30*d*, which are independent of one another, to the photosensitive drums 1*a* to 1*d* having respective colors via reduction gears 34*a* to 34*d*. Further, a driving force is transmitted to the drive roller 14, which allows the intermediate transfer belt 13 to rotate via a reduction gear group 40 and also via a driven coupling 43 arranged on one end of the drive roller 14. The intermediate transfer belt 13 contacts each surface of the photosensitive drums 1*a*-1*d*. Each of the photosensitive drums 1*a*-1*d* rotates in the same direction at approximately the same speed.

Figure 3:
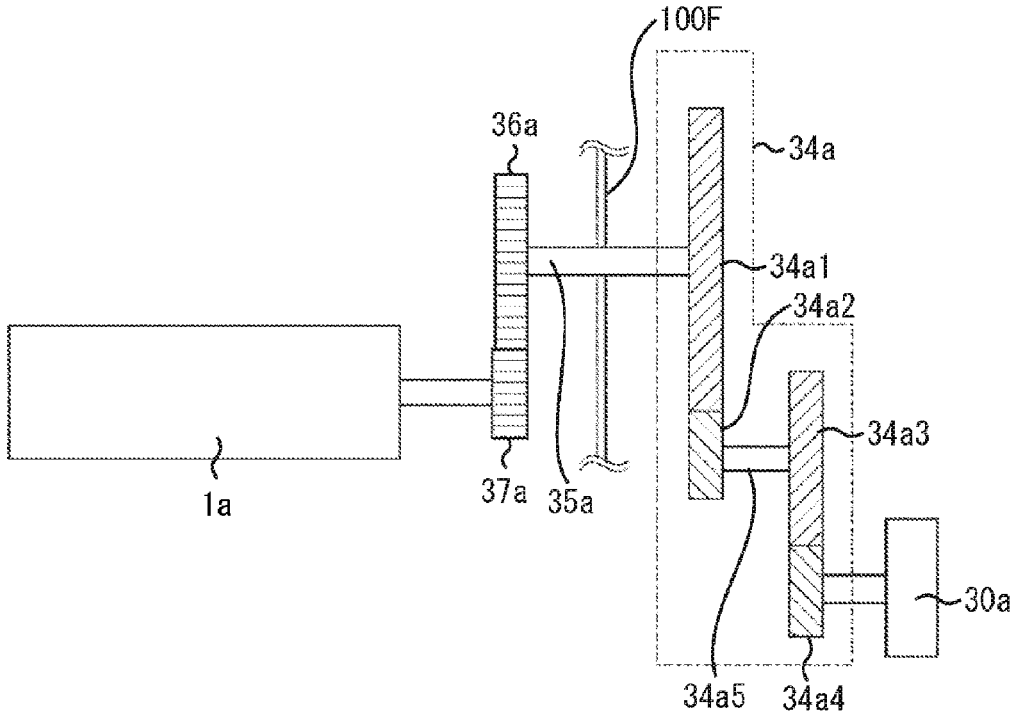
FIG. 3 illustrates an example of a drive transmission system of a photosensitive drum according to the first exemplary embodiment of the present invention.

Now, the transmission of driving force to the photosensitive drum 1*a* in the process cartridge 9*a* will be described referring to the example shown in FIG. 3. According to the example as shown, a driving force of a motor 30*a* is reduced by a reduction gear group 34*a* and transmitted to the photosensitive drum 1*a* via a gear 36*a* provided on a drive shaft 35*a*. The reduction gear group 34*a* includes gears 34*a*1 to 34*a*4 and a shaft 34*a*5 that provide a predetermined speed reduction ratio to the reduction gear group 34*a*. A gear 37*a*, which is provided at one end of the photosensitive drum 1*a* in the longitudinal direction, meshes with the gear 36*a*. The photosensitive drum 1*a* starts rotating when the gear 37*a* receives the driving force from the gear 36*a*. The gear 37*a* connected to the photosensitive drum 1*a* as well as the gear 36*a* connected to the drive shaft 35*a* may use a spur gear. When the process cartridge 9*a* is mounted in the apparatus main body 100A, the gear 37*a* meshes with the gear 36*a*. The insertion direction is the axial direction of the photosensitive drum 1*a*. Each of the photosensitive drums 1*b*-1*d* may also perform the drive transmission according to a similar configuration.

Figure 4:
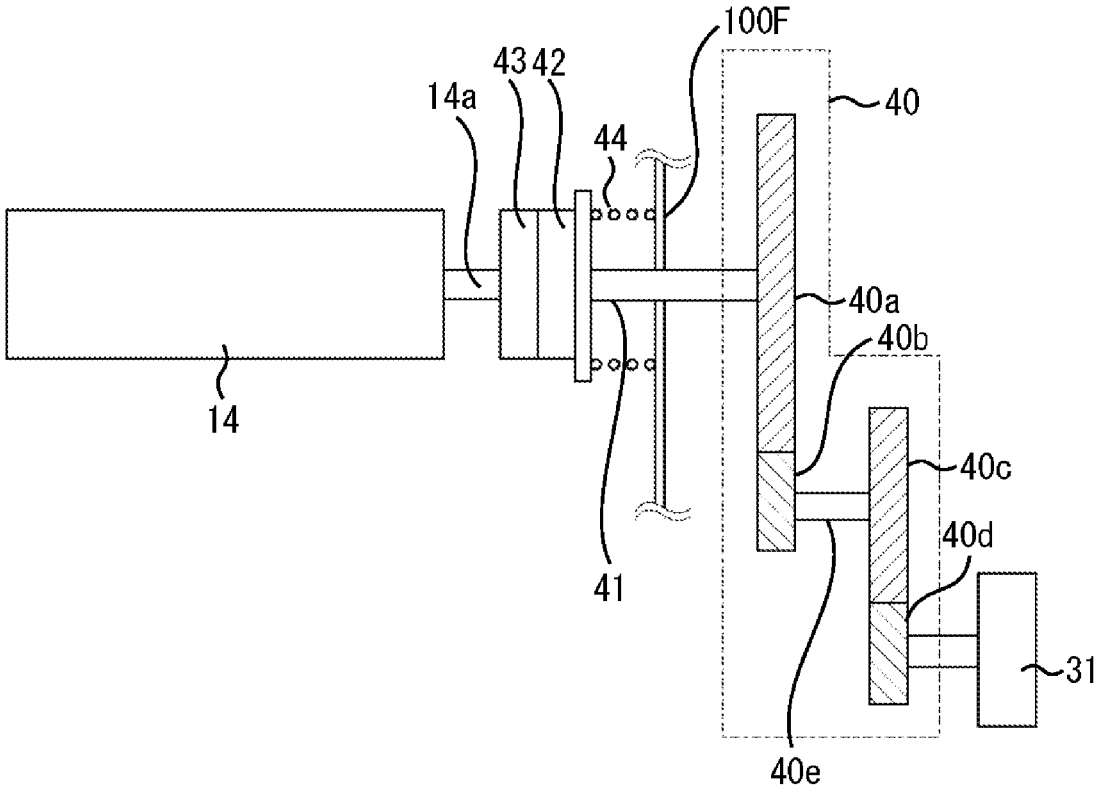
FIG. 4 illustrates an example of a drive transmission system of the intermediate transfer belt according to the first exemplary embodiment of the present invention.

Next, the transmission of driving force to the intermediate transfer belt 13 will be described referring to the example shown in FIG. 4. A driving force of a motor 31 is reduced by a reduction gear group 40 and transmitted to the drive roller 14, which makes the intermediate transfer belt 13 rotate, via a drive coupling 42 provided on a drive shaft 41. The reduction gear group 40 includes gears 40*a* to 40*d* and a shaft 40*e* that provide a predetermined speed reduction ratio to the reduction gear group 40. The driven coupling 43, which is fixed on one end of a shaft 14*a* of the drive roller 14 in the longitudinal direction, is connected to the drive coupling 42. The drive roller 14 starts rotating when the driven coupling 43 receives the driving force from the drive coupling 42.

Figure 5:
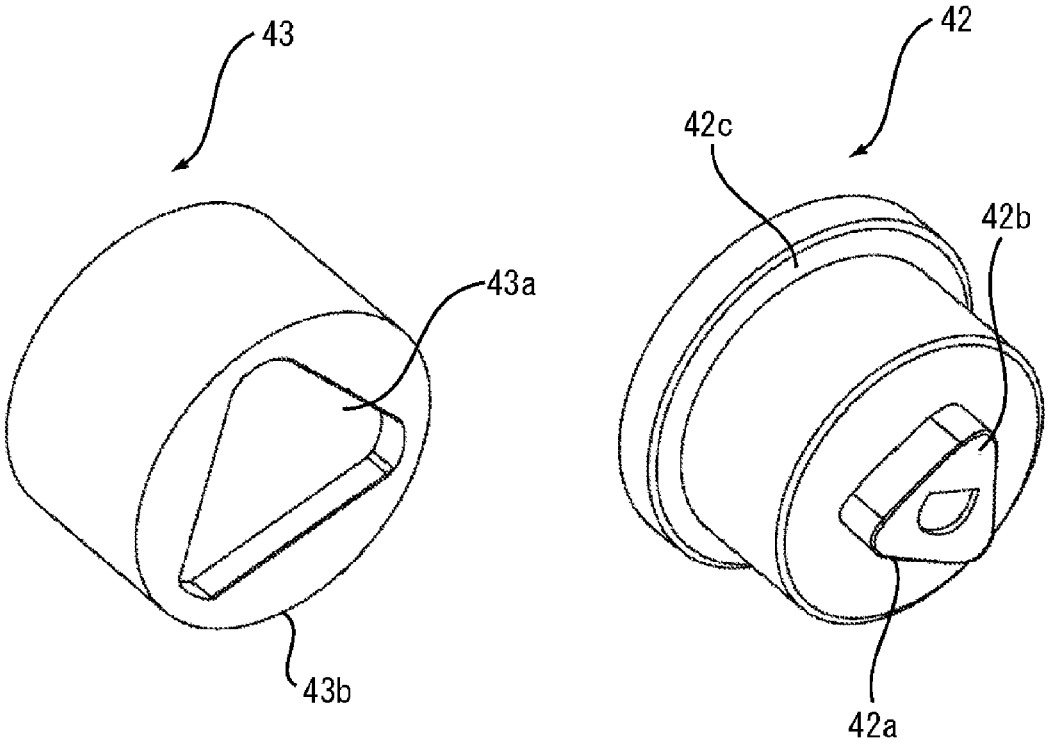
FIG. 5 illustrates an example of coupling members of a drive roller according to the first exemplary embodiment of the present invention.

FIG. 5 illustrates an example of a configuration of the drive coupling 42 and the driven coupling 43. The driven coupling 43 is provided at one end of the drive roller 14 and includes a triangular recessed portion 43*a* on its side. The recessed portion 43*a* is twisted (i.e., recessed) in the axial direction. Further, the drive coupling 42 provided on the drive shaft 41 includes a triangular raised portion 42*a* on its side. The raised portion 42*a* is also twisted (i.e. raised) in the axial direction. Thus, when the raised portion 42*a* fits into the recessed portion 43*a* and the drive coupling 42 starts rotating, the driving force is transmitted to the driven coupling 43 and, at the same time, a force that draws the couplings to each other is generated. It is to be noted that, as an example of an alternative configuration, the drive coupling can have a triangular recessed portion and the driven coupling can have a raised portion. In other words, the shapes of the couplings are not limited as long as one coupling has a triangular protrusion section and the other has a triangular hole section, into which the triangular projection is fittable.

Figure 7:
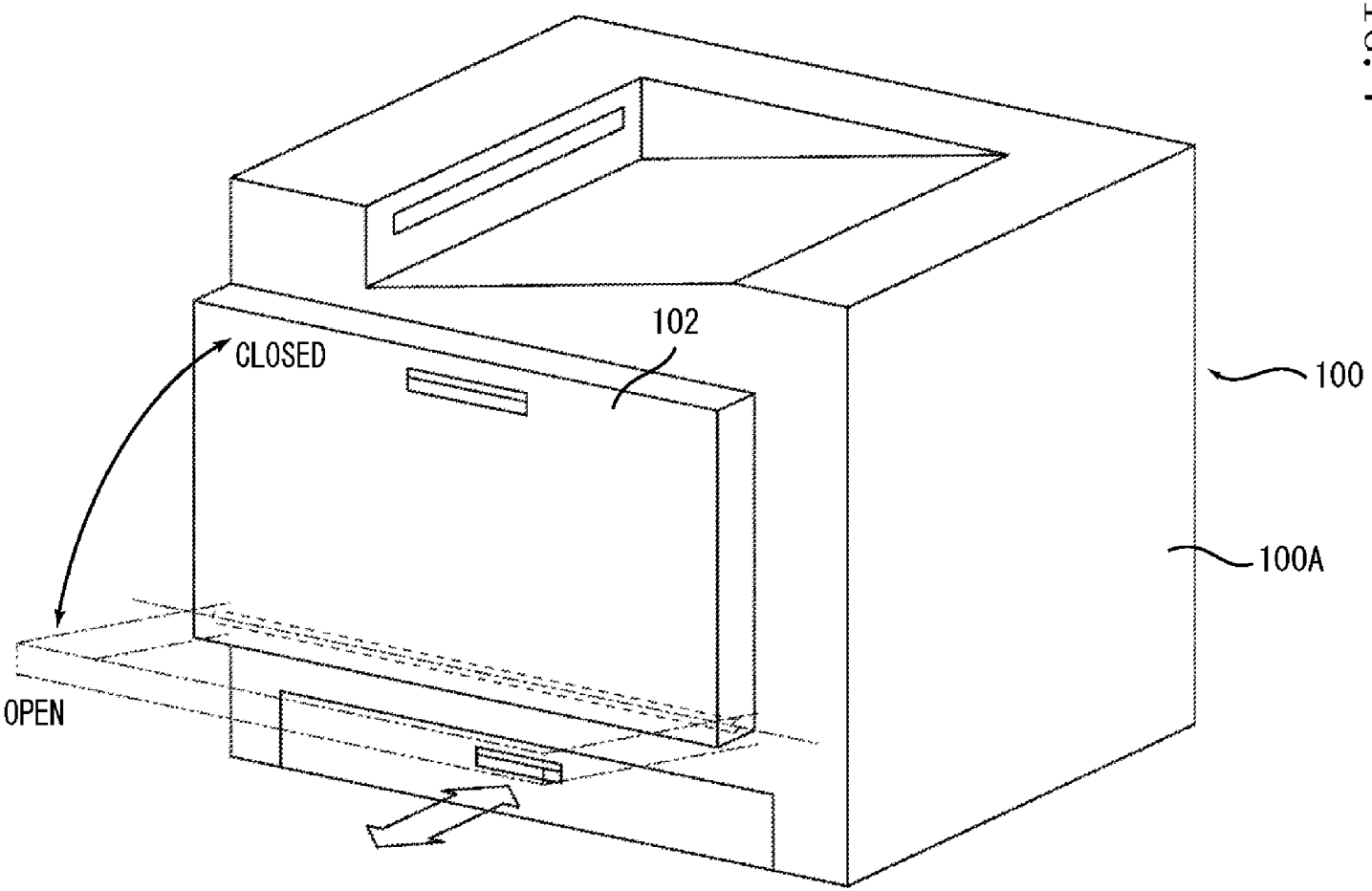
FIG. 7 illustrates an example of the image forming apparatus according to the first exemplary embodiment of the present invention.
Figure 14:
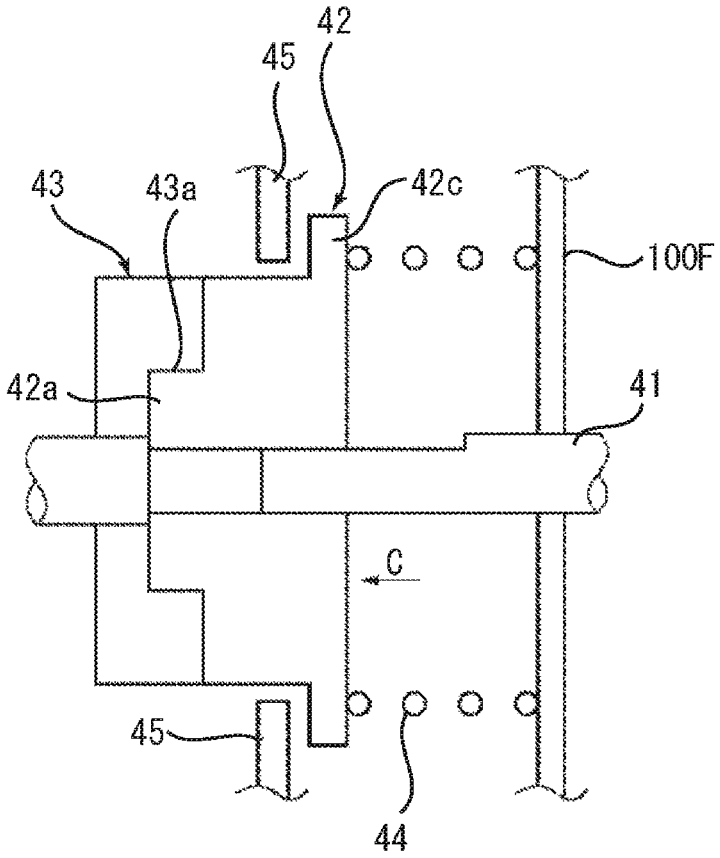
FIG. 14 illustrates an example of coupling members of the drive roller according to the first exemplary embodiment of the present invention.
Figure 15:
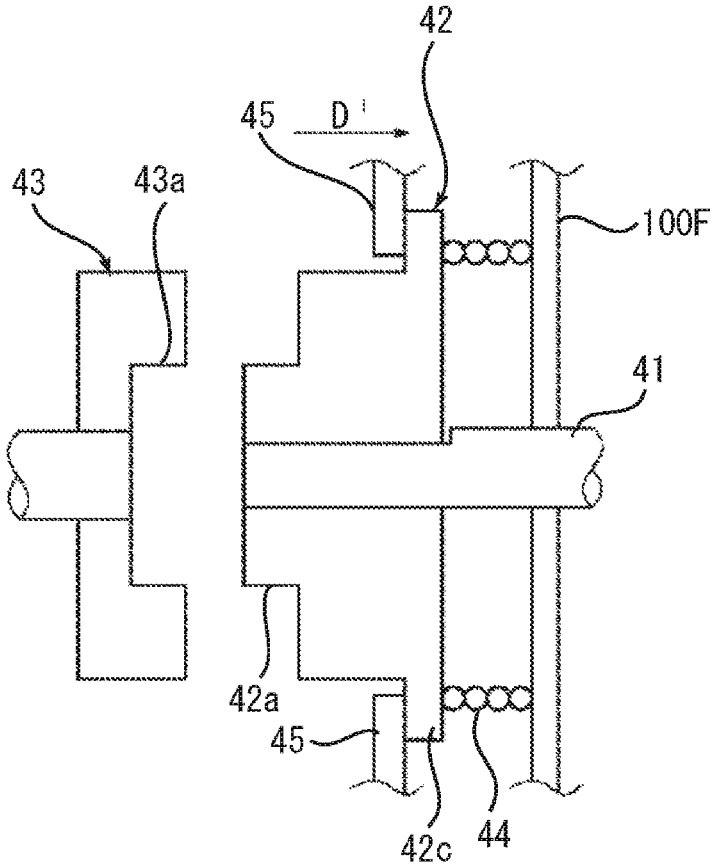
FIG. 15 illustrates an example of coupling members of the drive roller according to the first exemplary embodiment of the present invention.

Further, as illustrated in the examples shown in FIGS. 14 and 15, the drive coupling 42 may be configured to be movable in the axial direction of the drive shaft 41 in synchronization with the open/close operation of an open/close door 102. As illustrated in the example shown in FIG. 7, the open/close door 102 is movably provided on the apparatus main body 100A in such a manner that it can take either a closed state when an opening 101 (see, e.g., FIG. 1) provided on the apparatus main body 100A is closed, or an open state when the opening 101 is open. The opening 101 may be used, for example, when any of the process cartridges 9*a* to 9*d* is removed, the belt unit 103 including the intermediate transfer belt 13 is replaced, or jammed paper is removed.

As illustrated in the example shown in FIG. 14, when the open/close door 102 is closed, a force is applied to the drive coupling 42 in the direction indicated by the arrow C by a spring 44 provided between a main body frame 100F and the drive coupling 42. The drive coupling 42 and the driven coupling 43 may thus be connected in such a manner that the driving force of the motor 31 can be transmitted to the driven coupling 43. Further, as illustrated in the example shown in FIG. 15, when the open/close door 102 is opened, a flange portion 42*c* is pressed, and accordingly a release member 45 moves in the direction indicated by the arrow D. According to this movement, the drive coupling 42 moves to a release position where the connection with the driven coupling 43 is released. The connection portion of the drive coupling 42 and the driven coupling 43 is "D-shaped". Although, the drive coupling 42 is movable in the axial direction of the drive shaft 41, the rotation of the drive shaft 41 is transmitted to the drive coupling 42.

Figure 16:
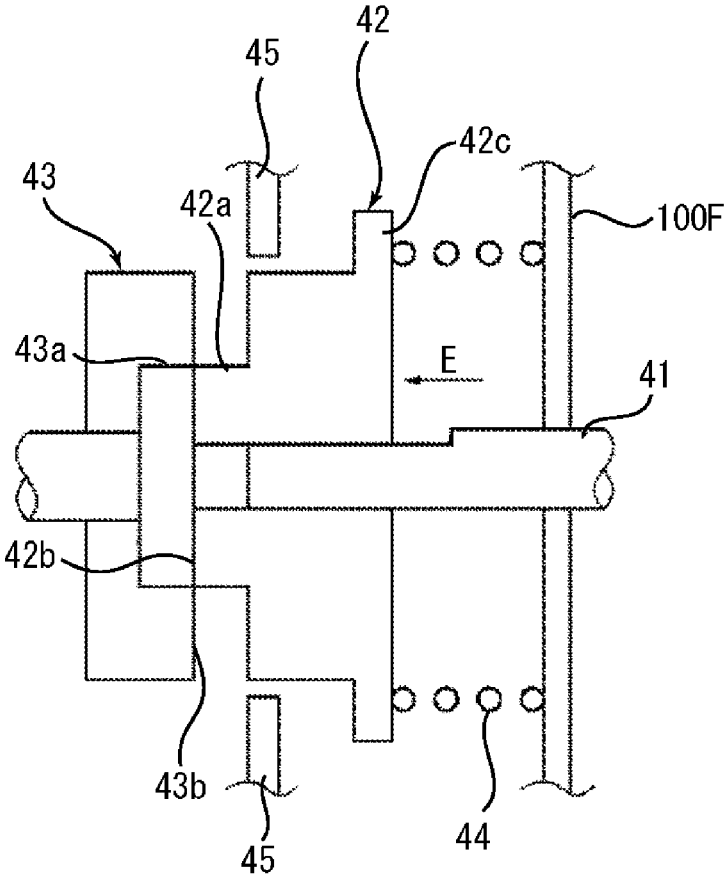
FIG. 16 illustrates an example of coupling members of the drive roller according to the first exemplary embodiment of the present invention.

When the open/close door 102 is closed from an open state, a force is applied to the drive coupling 42 by the spring 44 in the direction indicated by the arrow E. However, since the recessed portion 43*a* and the raised portion 42*a* of this embodiment are triangular in section as illustrated in the example shown in FIG. 5, if phase angles of the raised portion 42*a* and the recessed portion 43*a* do not match, then, as illustrated in the example shown in FIG. 16, an end face 42*b* of the drive coupling 42 will contact an end face 43*b* of the driven coupling 43, and the couplings will be in an abutting position. When the drive coupling 42 rotates to a maximum angle of 120 degrees, phase angles of the raised portion 42*a* and the recessed portion 43*a* match, and the raised portion 42*a* fits into the recessed portion 43*a*. In this way, the drive coupling 42 and the driven coupling 43 will be in an engagement position.

Figure 17:
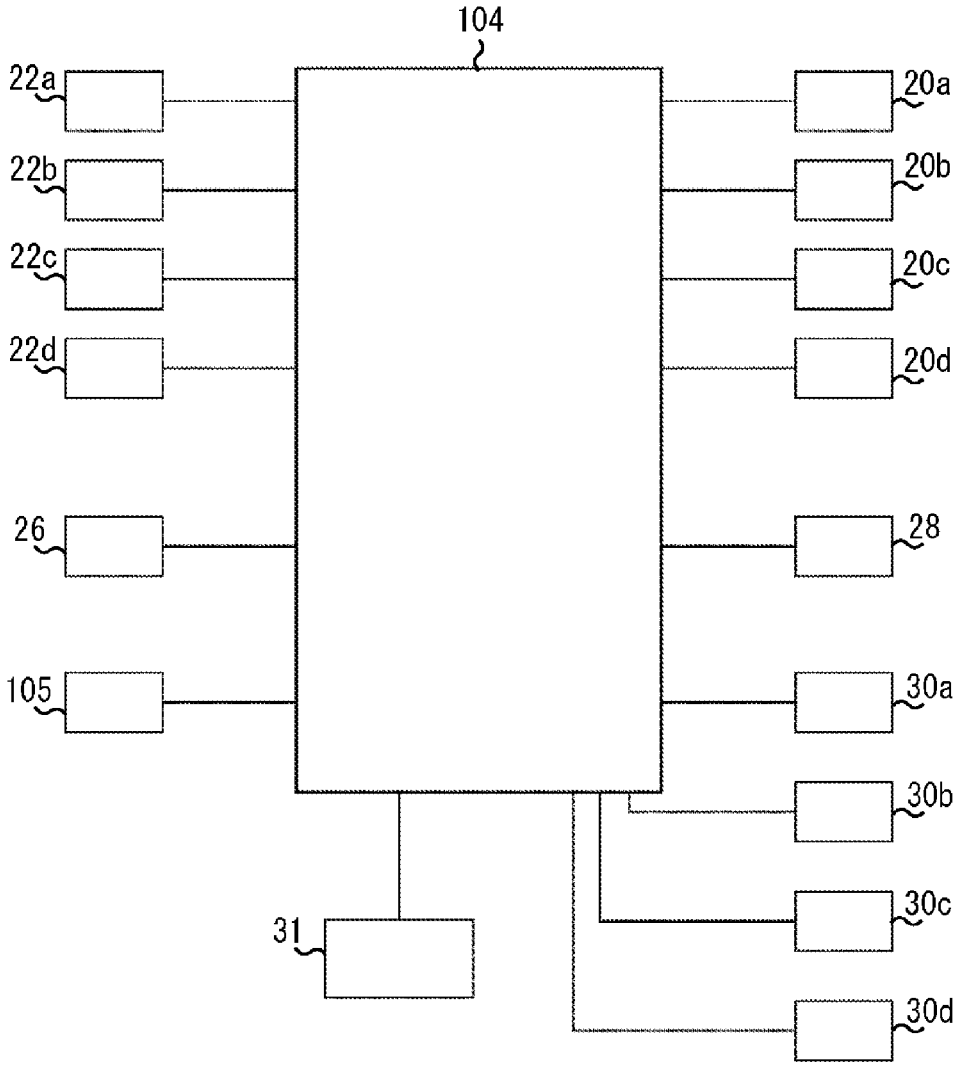
FIG. 17 illustrates an example of a block diagram of a control unit according to the first exemplary embodiment of the present invention.

As illustrated in the block diagram shown in the example of FIG. 17, a controller 104 as a control unit according to the present exemplary embodiment is electrically connected to the charge bias power supply units 20*a* to 20*d*, the primary transfer bias power supply units 22*a* to 22*d*, the secondary transfer bias power supply unit 26, the toner charge bias power supply unit 28, the motors 30*a* to 30*d* and 31, and a sensor 105 configured to detect whether the open/close door 102 is opened.

According to the image forming apparatus 100 of the present exemplary embodiment, since the resistance value of each of the intermediate transfer belt 13, the transfer rollers 10*a* to 10*d*, and the charging roller 2*a* varies depending on the environment, a preparation operation may be performed before the image forming operation. The preparation operation is an operation by which a bias voltage that is to be applied is corrected. This preparation operation may be performed when the open/close door 102 is opened or closed, or when the power of the image forming apparatus 100 is turned on.

However, since the movement of the drive coupling 42 is in synchronization with the movement of the open/close door 102 as described above, if the open/close door 102 is opened, the drive coupling 42 moves to the release position. On the other hand, if the open/close door 102 is closed, the drive coupling 42 also moves, but will be at the abutting position if it is not in phase with the driven coupling 43.

In this state, if the driving forces of the motors 30*a* to 30*d* and 31 are transmitted to the photosensitive drums 1*a* to 1*d* before they are transmitted to the intermediate transfer belt 13 in a preparation stage, then the photosensitive drum 1*a* will rotate while the intermediate transfer belt 13 is not rotating. In this case, if a bias voltage is applied to the charging roller 2*a*, a potential difference is generated between the surface of the photosensitive drum 1*a* and the intermediate transfer belt 13, which may then cause the photosensitive drum 1*a* to electrostatically attract the intermediate transfer belt 13. Accordingly, the photosensitive drum 1*a* may make the intermediate transfer belt 13 follow its movement in the same direction. Thus, the intermediate transfer belt 13 may rotate. This rotation may also cause the drive roller 14, to which the driven coupling 43 is arranged, to rotate. As a result, the state where the drive coupling 42 is not in phase with the driven coupling 43 (i.e., the unconnected state of the drive coupling 42 and the driven coupling 43) may continue. Thus, even if the image forming operation of the image forming apparatus 100 is started, the intermediate transfer belt 13 may rotate while being attracted to the photosensitive drum 1*a*, and the toner image will be formed on the photosensitive drum 1*a* in such a state.

When the toner image reaches a nip portion of the intermediate transfer belt 13 and the photosensitive drum 1*a*, the attracting force between the photosensitive drum 1*a* and the intermediate transfer belt 13 is reduced by the influence of the toner image. Thus, the rotation of the intermediate transfer belt 13 due to the electrostatic attraction between the photosensitive drum 1*a* and the intermediate transfer belt 13 may be stopped, but the transfer of the toner image onto the intermediate transfer belt 13 from the photosensitive drum 1*a* is continued. Then, the phase angle of the drive coupling 42 which is rotating according to the driving force generated by the motor 31 may match the phase angle of the driven coupling 43 which is not rotating. Subsequently, the couplings 42 and 43 are connected and move to the engagement position. Then, the drive roller 14 starts rotating as it receives the driving force of the motor 31. In such a state, the toner image is superposed on the intermediate transfer belt 13 and transferred, and thereby a defective image may be generated.

Further, a similar state may occur if the driving forces of the motors 30*a* to 30*d* and 31 are transmitted to the photosensitive drums 1*a* to 1*d* before they are transmitted to the intermediate transfer belt 13 in the preparation stage, and a bias voltage is applied to the charging roller 2*a*. That is, if the surface of the photosensitive drum 1*a* is charged, a potential difference may be generated between the surface of the photosensitive drum 1*a* and the intermediate transfer belt 13, which may then cause the photosensitive drum 1*a* to electrostatically attract the intermediate transfer belt 13. Accordingly, the photosensitive drum 1*a* may make the intermediate transfer belt 13 follow its movement in the same direction. Thus, the intermediate transfer belt 13 may rotate. This rotation can also cause the drive roller 14, to which the driven coupling 43 is arranged, to rotate. As a result, the state where the drive coupling 42 is not in phase with the driven coupling 43 (i.e., the unconnected state of the drive coupling 42 and the driven coupling 43) may continue. Thus, the toner image may be formed on the photosensitive drum 1*a* while the intermediate transfer belt 13 rotates while being attracted to the photosensitive drum.

When the toner image reaches a nip portion of the intermediate transfer belt 13 and the photosensitive drum 1*a*, the attracting force between the photosensitive drum 1*a* and the intermediate transfer belt 13 may be reduced by the influence of the toner image. Thus, the rotation of the intermediate transfer belt 13 due to the electrostatic attraction between the photosensitive drum 1*a* and the intermediate transfer belt 13 may be stopped, but the transfer of the toner image onto the intermediate transfer belt 13 from the photosensitive drum 1*a* may be continued. Then, the phase angle of the drive coupling 42 which is rotating according to the driving force generated by the motor 31 may be brought to match the phase angle of the driven coupling 43 which is not rotating. Subsequently, the couplings 42 and 43 are connected and move to the engagement position. Then, the drive roller 14 starts rotating as it receives the driving force of the motor 31. In such a state, the toner image may be superposed on the intermediate transfer belt 13 and transferred, and thereby a defective image may be generated.

Thus, according to the present exemplary embodiment, a bias voltage is not applied to the primary transfer rollers 10*a* to 10*d* during the connection time, which is the time for the connection of the drive coupling 42 and the driven coupling 43, after the motors 30*a* to 30*d* and 31 are started. That is, the controller 104 drives the motor 31 so that the drive coupling 42 is moved to the engagement position, and after a driving force of the motor 31 is transmitted to the driven coupling 43, the controller 104 controls each of the primary transfer bias power supply units 22*a* to 22*d* as a voltage application unit so that the voltage is applied to each of the transfer rollers 10*a* to 10*d*.

Figure 6A:
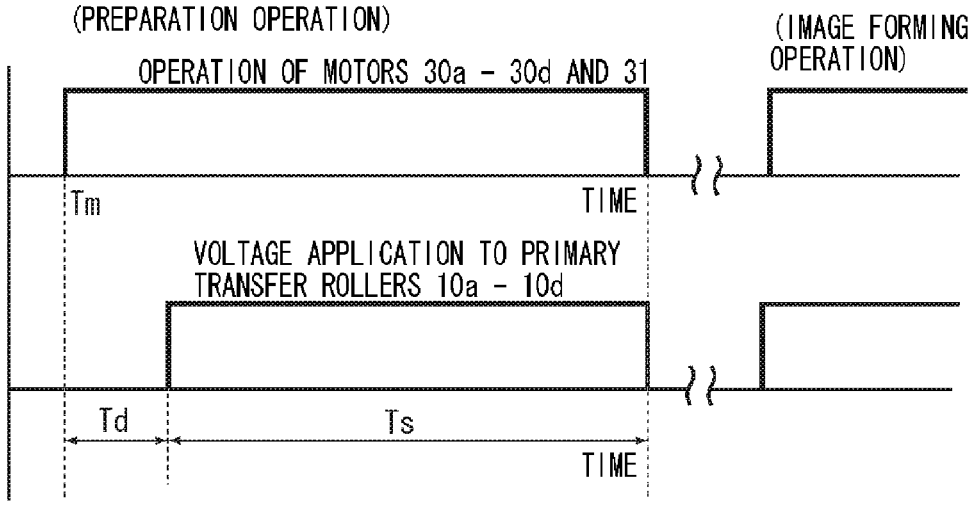
FIGS. 6A and 6B illustrate an example of voltage application timing according to the first exemplary embodiment of the present invention.
Figure 6B:
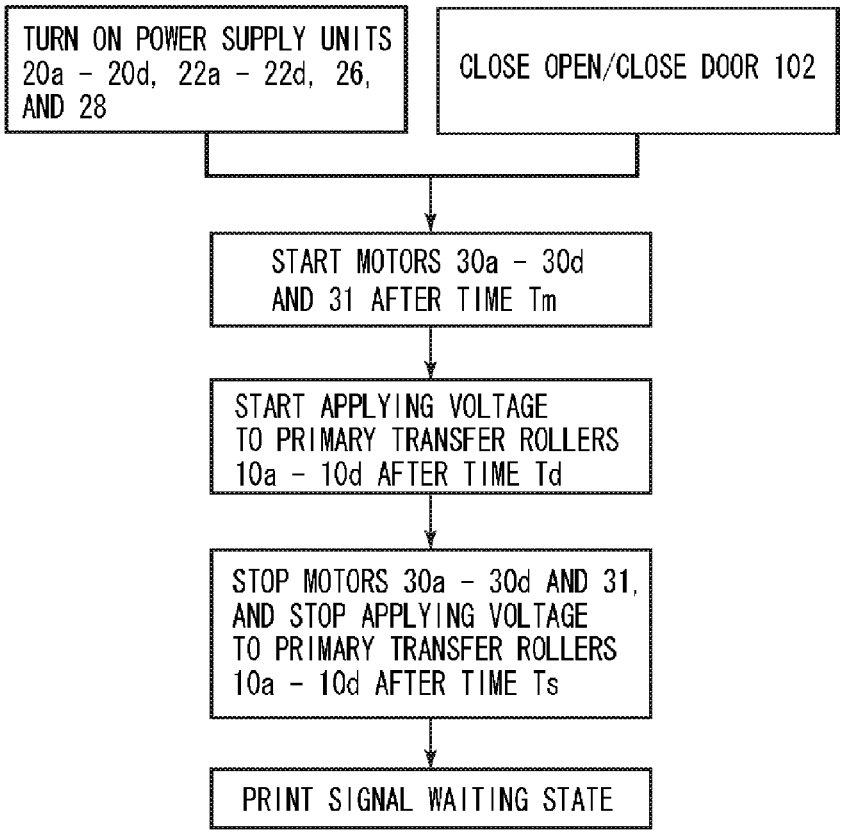

Details of the control will now be described referring to the examples shown in FIGS. 6A and 6B. If the power supply of the image forming apparatus 100 is turned on, or if the open/close door 102 is closed from an open state, the controller 104 performs the preparation operation for receiving a print signal for starting the image forming operation of the image forming apparatus 100. For example, the resistance value of each of the intermediate transfer belt 13, the transfer rollers 10*a* to 10*d*, and the charging rollers 2*a* to 2*d* may vary depending on a use environment of the image forming apparatus 100. Thus, the optimum bias voltage to be applied to the transfer rollers 10*a* to 10*d* and the charging rollers 2*a* to 2*d* may be determined in this preparation operation. It is to be noted that "the state in which the power supply of the image forming apparatus 100 is turned on" is a state where the charge bias power supply units 20*a* to 20*d*, the primary transfer bias power supply units 22*a* to 22*d*, the secondary transfer bias power supply unit 26, and the toner charge bias power supply unit 28 are electrically connected to a commercial power source. Further, the open/close door 102 may be typically opened, for example, when any of the process cartridges 9*a*-9*d* is removed, the belt unit 103 including the intermediate transfer belt 13 is replaced, or a paper jam is cleared.

The controller 104 outputs signals for starting the motors 30*a* to 30*d* and 31*a* time Tm after the power is turned on or the open/close door 102 is closed. Further the controller 104 outputs signals for starting application of voltage to the primary transfer bias power supply units 22*a* to 22*d* to start applying voltages to the primary transfer rollers 10*a* to 10*d* a time Td after the signals for starting the motors 30*a* to 30*d* and 31 are output. Here, the time Td is longer than a maximum connection time Tc which is a maximum time for connecting the drive coupling 42 to the driven coupling 43. According to the present exemplary embodiment, the maximum connection time Tc is a time for drive coupling 42 to rotate approximately 120 degrees at the maximum, since the recessed portion 43*a* and the raised portion 42*a* are triangular. If the process speed Vps (mm/sec) is defined using the middle point of the thickness of the intermediate transfer belt 13, since the outer diameter of the drive roller 14 of the present exemplary embodiment is 20 mm, T equals to or greater than $1000\times120/360\times(20\pi+50/1000)/Vps$ (msec). Further, the motors 30*a* to 30*d* and 31 are stopped and the voltage application to the primary transfer rollers 10*a* to 10*d* is stopped at a time Ts after the application of the voltage to the primary transfer rollers 10*a* to 10*d* is started. Then, the controller 104 may enter into a print signal waiting state and wait until it receives the print signal used for image forming.

According to the configuration of the present exemplary embodiment, when the process cartridge 9*a* is mounted in the apparatus main body 100A, the gear 37*a* which is provided at one end of the photosensitive drum 1*a* meshes with the gear 36*a* on the side of the main body. As described above, in some cases, however, the end face 42*b* of the drive coupling 42 illustrated in the example shown in FIG. 16 contacts the end face 43*b* of the driven coupling 43 provided on the drive roller 14, and thus the couplings are not connected when the open/close door 102 is closed from an open state. In this case, the photosensitive drum 1*a* will start rotating before the intermediate transfer belt 13. Thus, the supply of a bias voltage to the primary transfer roller 10*a* by the primary transfer bias power supply unit 22*a* will be started after the motors 30*a* and 31 are started. In this way, the intermediate transfer belt 13 can be prevented from being attracted to the photosensitive drum 1*a* due to the electrostatic attraction force that is generated by the electric potential difference between the surface of the photosensitive drum 1*a* and the intermediate transfer belt 13. Since the intermediate transfer belt 13 is not attracted and the drive roller 14 is not affected by the rotation of the intermediate transfer belt 13, the drive coupling 42 is connected to the driven coupling 43 before the drive coupling 42 rotates more than 120 degrees at the maximum.

When the above-described preparation operation is finished, the driven coupling 43 and the drive coupling 42 are generally relatively securely connected. This may help improve throughput of the image forming operation. Further, since the image forming operation is started based on the securely-connected couplings, the generation of a defective image due to poor connection of the couplings may be prevented.

Figure 25A:
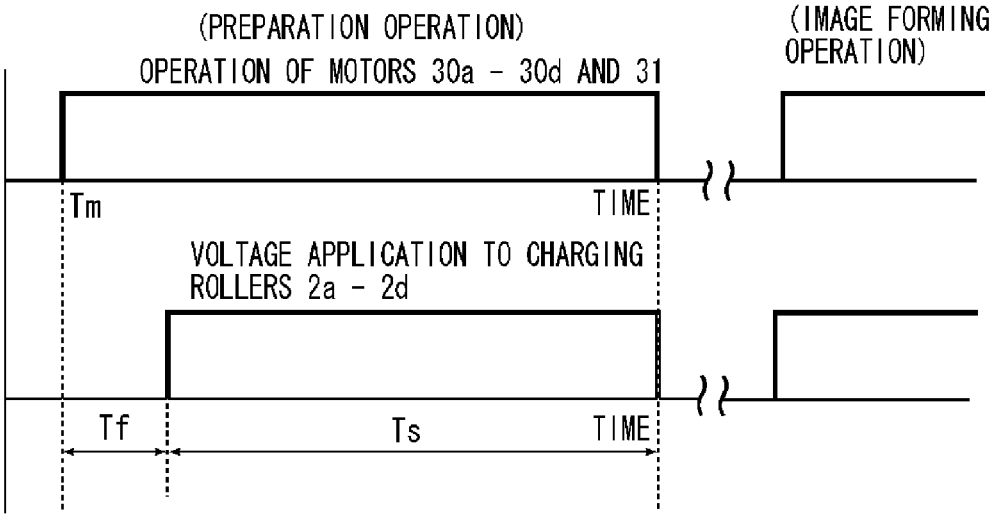
FIGS. 25A and 25B illustrate an example of voltage application timing according to the first exemplary embodiment of the present invention.
Figure 25B:
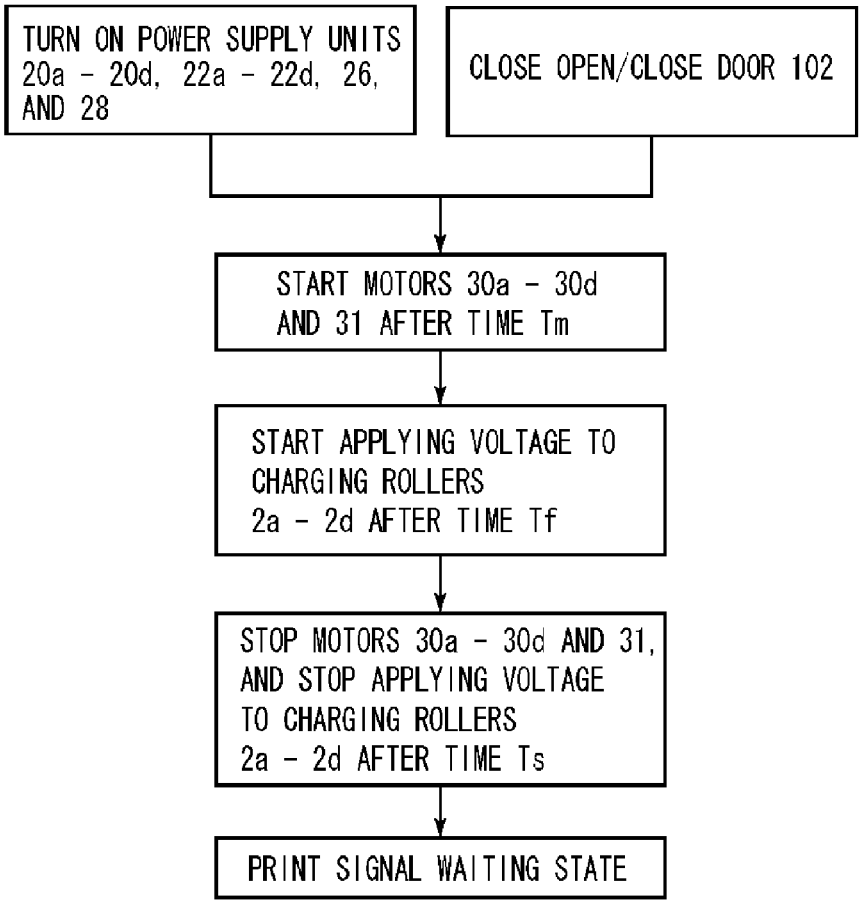

Since the voltage application to the primary transfer roller 10*a* has been described above, now, timing of voltage application to the charging roller 2*a* will be described referring to the examples shown in FIGS. 25A and 25B. If voltage is applied to the charging roller 2*a* at the same time the signals used for starting the motors 30*a* and 31 are output, the portion of the photosensitive drum 1*a* that has been charged by the charging roller 2*a* may reach a position where the photosensitive drum 1*a* contacts the intermediate transfer belt 13 at a predetermined time Te earlier. At this time, by the electrostatic attraction force that is generated by the electric potential difference between the photosensitive drum 1*a* and the intermediate transfer belt 13, the intermediate transfer belt 13 may be attracted to the photosensitive drum 1*a*. In order to prevent this from occurring, the voltage application to the charging roller 2*a* will be started after the signals used for starting the motors 30*a* and 31 are output. In this way, the intermediate transfer belt 13 may be prevented from being attracted to the photosensitive drum 1*a*. That is, voltage application to the primary transfer roller 10*a* by the primary transfer bias power supply unit 22*a* will not be started during the connection time of the driven coupling 43 and the drive coupling 42 after the motors 30*a* and 31 are started.

However, if a voltage is applied to the charging roller 2*a* by the charge bias power supply unit 20*a*, the portion of the photosensitive drum 1*a* that has been charged by the charging roller 2*a* takes the time Te to reach the position where the photosensitive drum 1*a* contacts the intermediate transfer belt 13. This means that timing Tf, which is the time the voltage application to the charging roller 2*a* is started after the signals for starting the motors 30*a* and 31 are output, may be set so that it comes after the time obtained by subtracting the time Te from the time Tc, which is a maximum connection time for the driven coupling 43 and the drive coupling 42, has passed after the start of the motors. Further the controller 104 may control the charge bias power supply unit 20*a* to start applying a voltage to the charge roller 2*a* so that the portion of the photosensitive drum 1*a* charged by the charge roller 2*a* does not reach the position where the portion contacts the intermediate transfer belt 13 until the driving force is transmitted to the driven coupling 43 after the motors 30*a* and 31 are started. In other words, the controller 104 may drive the motor 31 so that the drive coupling 42 is moved to the engagement position, and may control the charge bias power supply unit 20*a* to apply a voltage to the charging roller 2*a* so that a portion of the photosensitive drum 1*a* charged by the charging roller 2*a* reaches the position where the portion contacts the intermediate transfer belt 13 after the driving force is transmitted to the driven coupling 43 by the driving force of the motor 31.

The above-described control may be performed when the power is turned on, for example since the open/close door 102 can be opened and closed while the power is turned off. According to the present exemplary embodiment, a voltage is applied to at least one of the charging roller 2 and the primary transfer roller 10 at a certain time after the signals for starting the motors 30 and 31 are output. However, voltage can be also be applied to both the charging roller 2 and the primary transfer roller 10 a certain time after the signals for starting the motors 30 and 31 are output.

Next, a second exemplary embodiment of the present invention will be described.

According to the present exemplary embodiment, components similar to those in the first exemplary embodiment are denoted by the same reference numerals and their description is omitted for simplification.

According to the first exemplary embodiment, independent motors 30*a* to 30*d* are provided for the photosensitive drums 1*a* to 1*d* for CMYK colors, respectively, and the motor 31 is provided for the drive roller 14 of the intermediate transfer belt 13.

Figure 8:
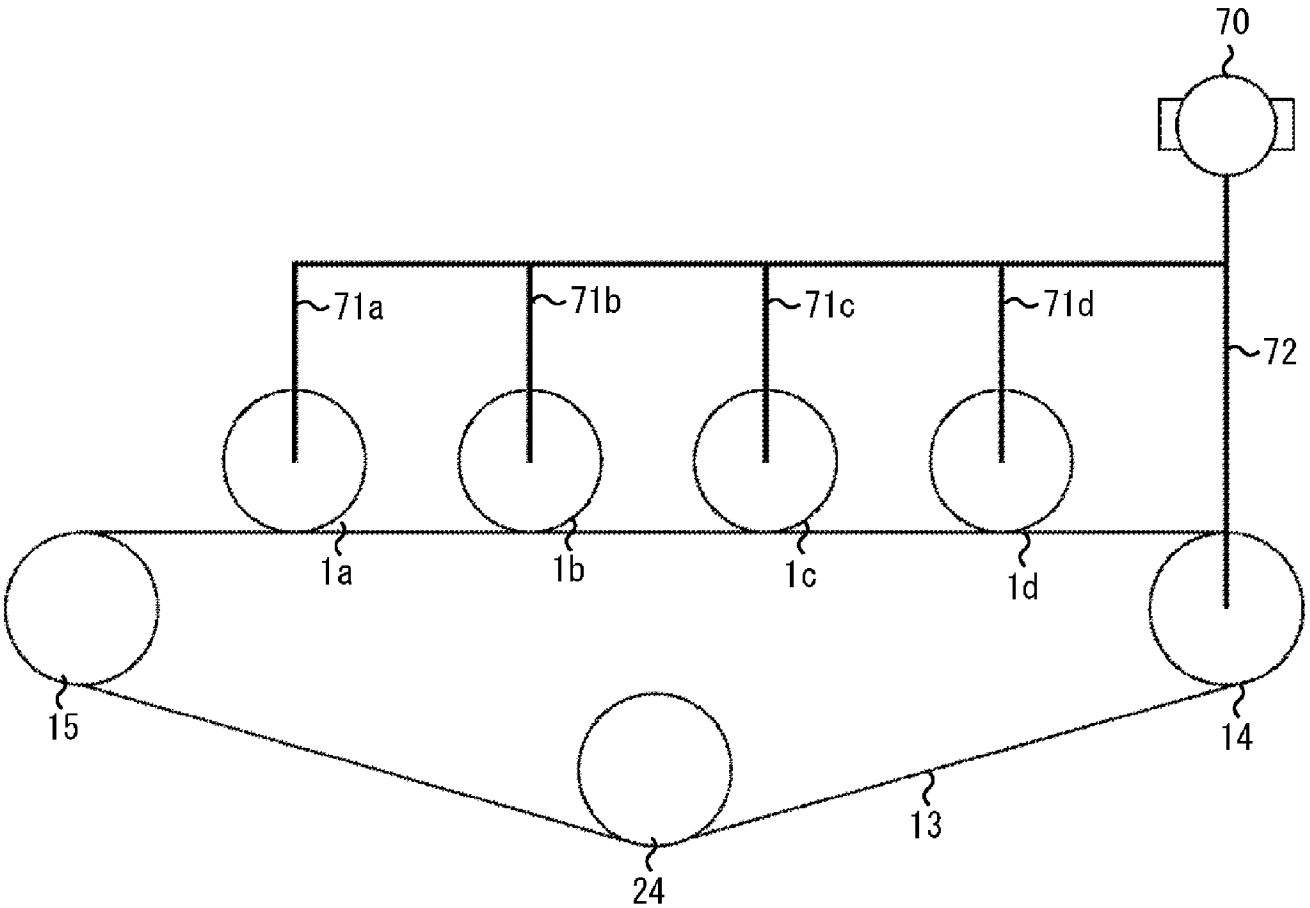
FIG. 8 illustrates an example of a drive transmission system of photosensitive drums and an intermediate transfer belt used in a second exemplary embodiment of the present invention.

As illustrated in the example shown in FIG. 8, according to the present exemplary embodiment, the photosensitive drums 1*a* to 1*d* and the drive roller 14 are driven by a common motor 70. Driving force is transmitted to the photosensitive drums 1*a* to 1*d* from the motor 70 via reduction gear groups 71*a* to 71*d*. Further, a driving force is transmitted to the drive roller 14 of the intermediate transfer belt 13 from the motor 70 via reduction gear groups 72. The intermediate transfer belt 13 contacts the surfaces of the photosensitive drums 1*a* to 1*d*, each of which rotates in the same direction at approximately the same speed.

Figure 9:
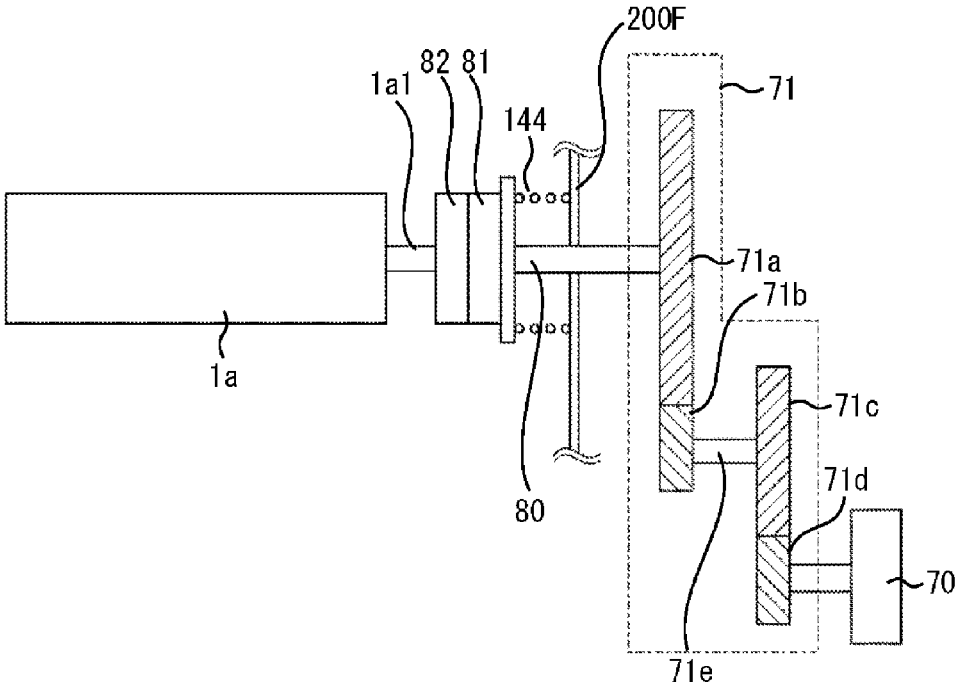
FIG. 9 illustrates an example of a drive transmission system of a photosensitive drum according to the second exemplary embodiment of the present invention.

Next, the transmission of driving force to the photosensitive drum 1*a* of the process cartridge 9*a* will be described in detail referring to the example shown in FIG. 9. The driving force of the motor 70 is transmitted to a drum coupling 82, which is provided at one end of a shaft 1*a*1 of the photosensitive drum 1*a*, via a reduction gear group 71 and a main-body coupling 81, and thus transmitted to the photosensitive drum 1*a*. A driving force of the motor 70 is reduced by the reduction gear group 71 and transmitted to the drum coupling 82 and further to the photosensitive drum 1*a* via the main-body coupling 81 provided on an end of a drive shaft 80. The reduction gear group 71 includes gears 71*a* to 71*d* and a shaft 71*e*, and is configured to have a predetermined speed reduction ratio. The drum coupling 82, which is fixed on one end of the photosensitive drum 1*a* in the longitudinal direction, is connected to the main-body coupling 81. The photosensitive drum 1*a* starts rotating when the drum coupling 82 receives the driving force from the main-body coupling 81.

Figure 18:
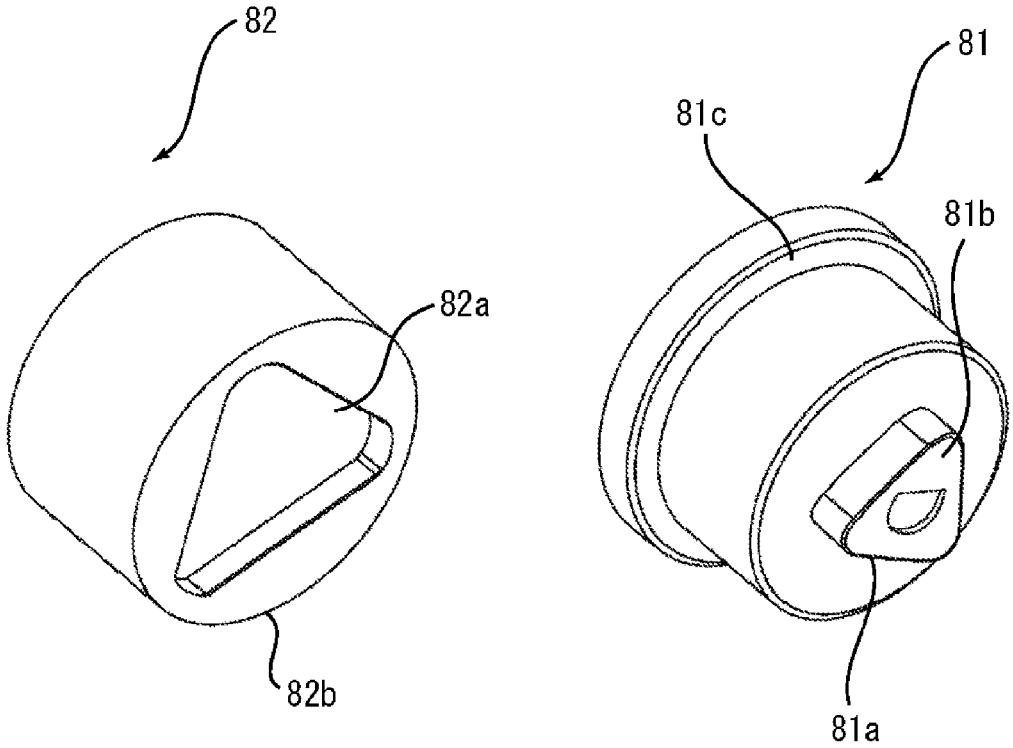
FIG. 18 illustrates an example of coupling members of a drum according to the second exemplary embodiment of the present invention.

FIG. 18 illustrates an example of the configuration of the main-body coupling 81 and the drum coupling 82. The main-body coupling 81 is provided at one end of the drive shaft 80 and includes a triangular raised portion 81*a* on its side. The raised portion 81*a* is twisted (i.e. raised) in the axial direction. Further, the drum coupling 82 provided on the photosensitive drum 1*a* includes a triangular recessed portion 82*a* on its side. The recessed portion 82*a* is also twisted (i.e., recessed) in the axial direction. Thus, when the raised portion 81*a* fits into the recessed portion 82*a* and the main-body coupling 81 starts rotating, the driving force is transmitted to the drum coupling 82 and, at the same time, a force that draws the couplings to each other is generated. Further, driving forces are transmitted according to a similar configuration of each of the photosensitive drums 1*b* to 1*d*. Alternatively, the main-body coupling can have a triangular recessed portion and the drum coupling can have a raised portion. In other words, the shapes of the couplings are not limited so long as one coupling has a triangular protrusion section and the other has a triangular hole section, into which the triangular projection is fittable.

Figure 19:
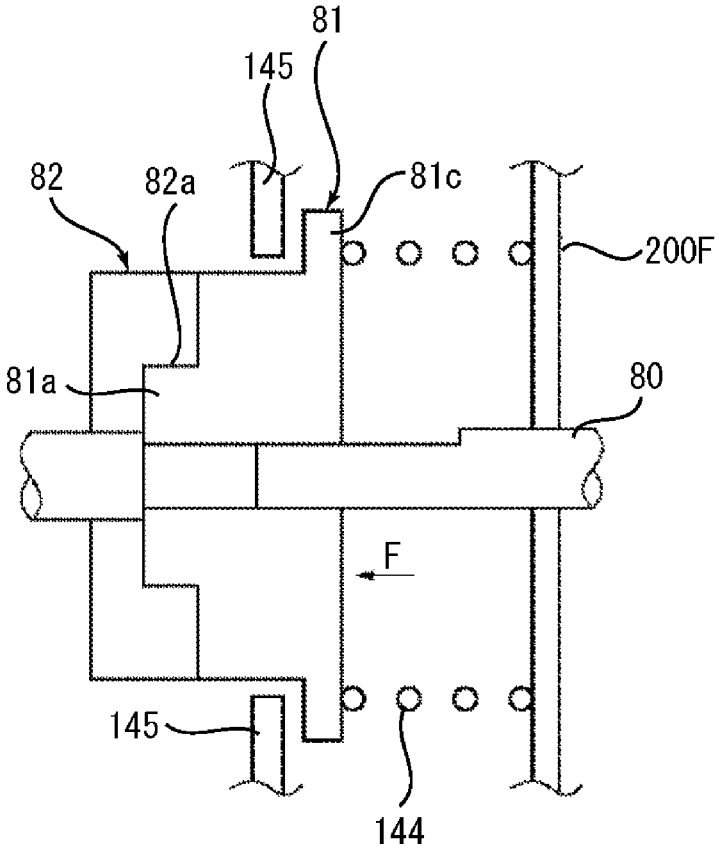
FIG. 19 illustrates an example of coupling members of the drum according to the second exemplary embodiment of the present invention.
Figure 20:
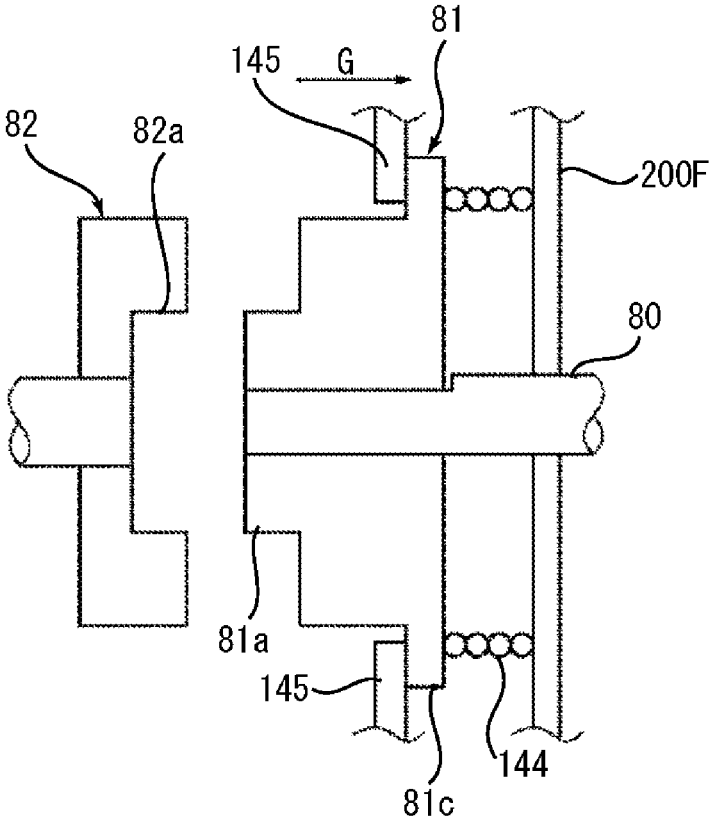
FIG. 20 illustrates an example of coupling members of the drum according to the second exemplary embodiment of the present invention.

Further, as illustrated in the examples shown in FIGS. 19 and 20, the main-body coupling 81 may be configured to be movable in the axial direction of the drive shaft 80 in synchronization with the open/close operation of the open/close door 102. As illustrated in the example shown in FIG. 19, when the open/close door 102 is closed, a force is applied to the main-body coupling 81 in the direction indicated by the arrow F by a spring 144 provided between a main body frame 200F and the main-body coupling 81. The main-body coupling 81 and the drum coupling 82 may thus be connected in such a manner that the driving force of the motor 70 can be transmitted to the drum coupling 82. Further, as illustrated in the example shown in FIG. 20, when the open/close door 102 is opened, a flange portion 81*c* is pressed, and accordingly a release member 145 moves in the direction indicated by the arrow G. According to this movement, the main-body coupling 81 moves to a release position where the fitting with the drum coupling 82 is released. The connection portion of the drive shaft 80 and the main-body coupling 81 is "D-shaped". Although, the main-body coupling 81 may be movable in the axial direction of the drive shaft 80, and the rotation of the drive shaft 80 may be transmitted to the main-body coupling 81.

Figure 21:
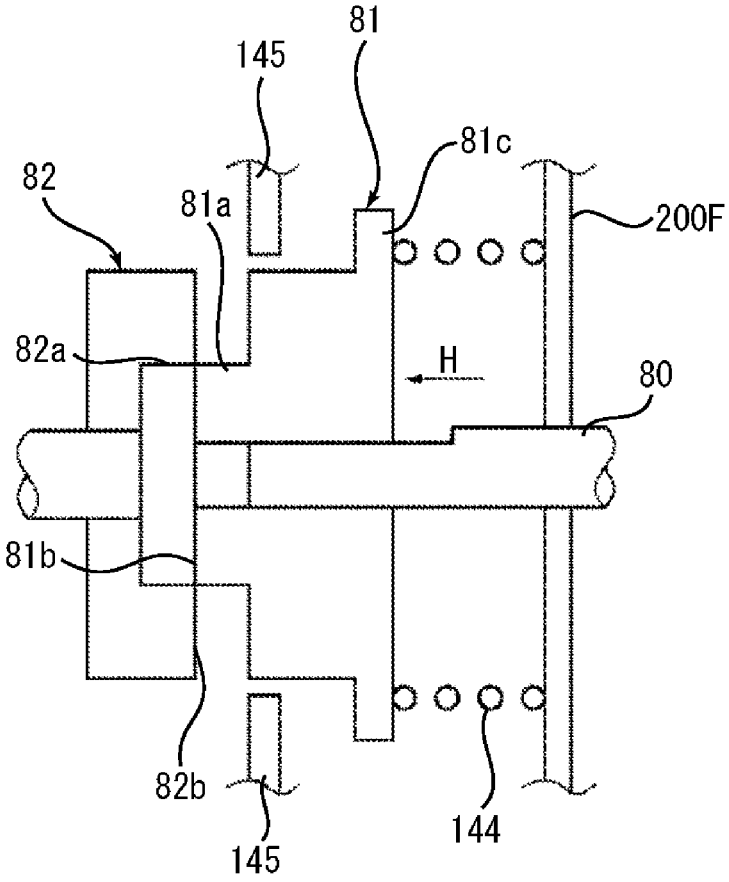
FIG. 21 illustrates an example of coupling members of the drum according to the second exemplary embodiment of the present invention.

When the open/close door 102 is closed from an open state, a force is applied to the main-body coupling 81 in the direction of the drum coupling 82 by the spring 144. However, since the raised portion 81*a* and the recessed portion 82*a* are triangular in section as illustrated in the example shown in FIG. 18, if phase angles of the recessed portion 82*a* and the raised portion 81*a* do not match, then, as illustrated in the example shown in FIG. 21, an end face 81*b* of the main-body coupling 81 will contact an end face 82*b* of the drum coupling 82. Thus, the main-body coupling 81 and the drum coupling 82 will be in an abutting position. When the main-body coupling 81 rotates at a maximum angle of 120 degrees, phase angles of the raised portion 81*a* and the recessed portion 82*a* can be made to match, and the raised portion 81*a* may fit into the recessed portion 82*a*. In this way, the main-body coupling 81 is connected to the drum coupling 82. The main-body coupling 81 and the drum coupling 82 will be in the engagement position.

Figure 10:
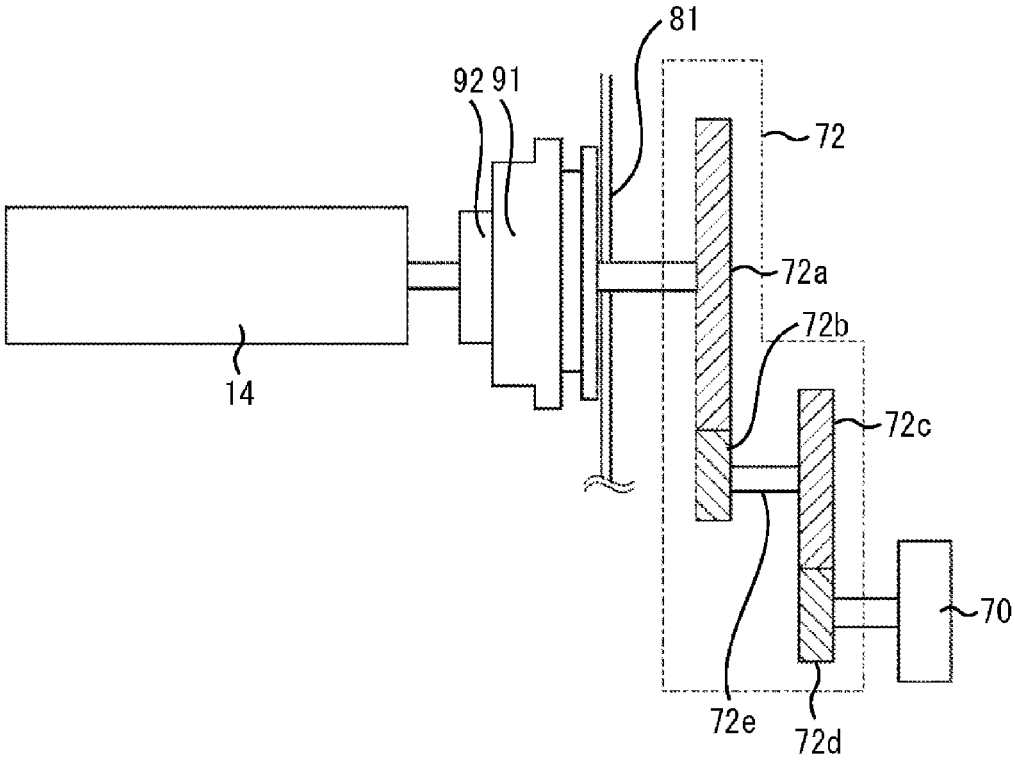
FIG. 10 illustrates an example of a drive transmission system of the intermediate transfer belt according to the second exemplary embodiment of the present invention.

Further, as illustrated in the example shown in FIG. 10, a driving force of the motor 70 is transmitted to a driven coupling 92, which is provided at one end of the drive roller 14 that drives the intermediate transfer belt, via a reduction gear group 72 and a drive coupling 91. In this way, the driving force is transmitted to the drive roller 14. The reduction gear group 72 includes gears 72*a* to 72*d* and a shaft 72*e* that provide a predetermined speed reduction ratio to the reduction gear group 72.

Figure 11:
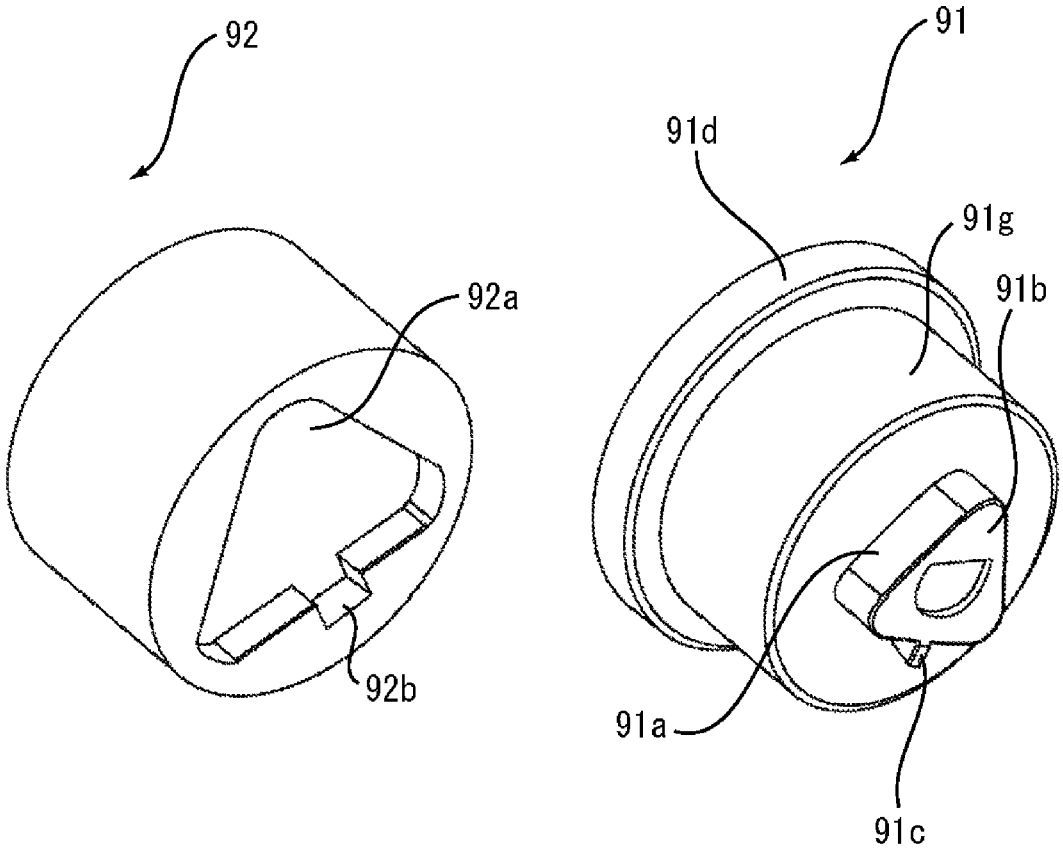
FIG. 11 illustrates an example of coupling members of a drive roller according to the second exemplary embodiment of the present invention.

FIG. 11 illustrates examples of configurations of the drive coupling 91 and the driven coupling 92. The drive coupling 91 is provided at one end of the drive shaft 80 and includes a triangular raised portion 91*a* on its side. Further, the driven coupling 92 provided at one end of the drive roller 14 includes a triangular recessed portion 92*a* on its side.

Further, the raised portion 91*a* of the drive coupling 91 includes a protrusion 91*c* formed on its side so that the drive coupling 91 and the driven coupling 92 are connected at a phase angle of 360 degrees. Further, the driven coupling 92 includes a notch 92*b*. The protrusion 91*c* fits into the notch 92*b*. When the drive coupling 91 and the driven coupling 92 are connected, the driving force is transmitted to the driven coupling 92 by the rotation of the drive coupling 91.

Figure 22C:
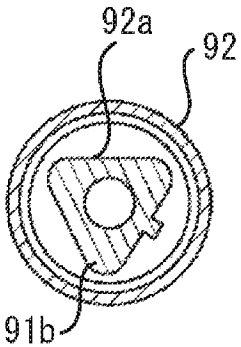
FIGS. 22A, 22B, and 22C illustrate an example of coupling members of the drive roller according to the second exemplary embodiment of the present invention.
Figure 22B:
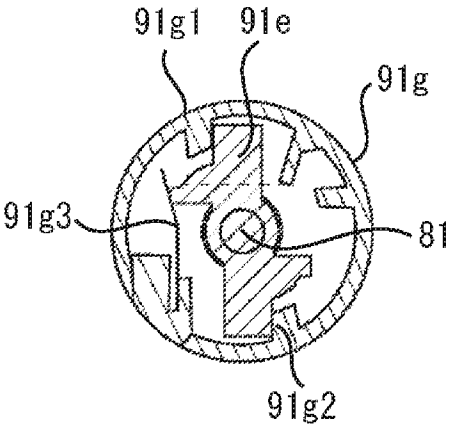
Figure 22A:
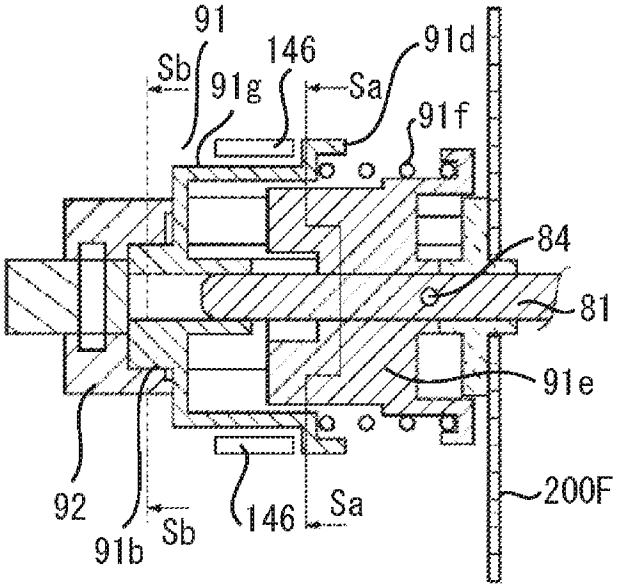

Next, referring to FIGS. 22A to 22C and FIGS. 23A to 23C, examples of detailed configurations of the drive coupling 91 will be described. FIG. 22A is a sectional view taken along the longitudinal direction of the drive coupling 91 and the driven coupling 92 in a connected state. FIG. 22B is a sectional view taken along line Sa-Sa in FIG. 22A. Further, FIG. 22C is a sectional view taken along line Sb-Sb in FIG. 22A.

The example of the drive coupling 91 as shown includes an intermediate part 91*e* and a cap 91*g*. The intermediate part 91*e* is fixed to the drive shaft 81 by a pin 84. A force is applied to the cap 91*g* by a spring 91*f* against the intermediate part 91*e* in the axial direction. A raised portion 91*b* is provided on one end of the cap 91*g*. A flange 91*d* is provided on the other end. The flange 91*b* is connected to a release member 146 described below. Further, as illustrated in the example shown in FIG. 22C, when the raised portion 91*a* fits into the recessed portion 92*a*, the rotation of the drive shaft 81 may be transmitted to the drive roller 14 as the intermediate part 91*e* is engaged with ribs 91*g*1 and 91*g*2 in the cap 91*g*. Further, a leaf spring 91*g*3 is provided in the cap 91*g*. The leaf spring 91*g*3 may apply force to the intermediate part 91*e* in a direction to move the intermediate part 91*e* away from the ribs 91*g*1 and 91*g*2.

Figure 23A:
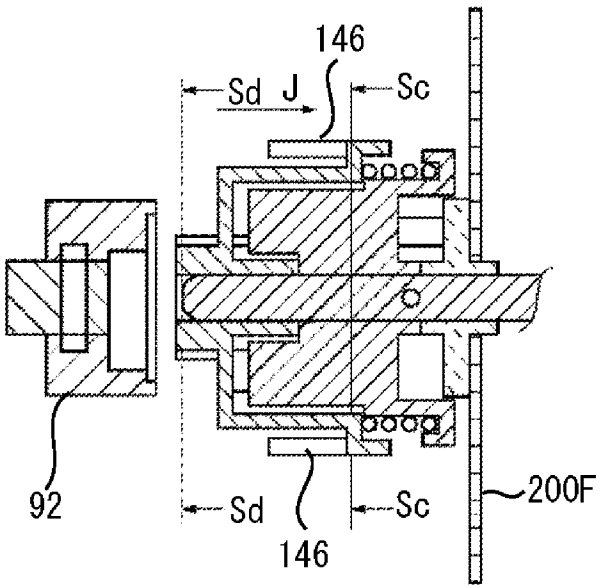
FIGS. 23A, 23B, and 23C illustrate an example of coupling members of the drive roller according to the second exemplary embodiment of the present invention.
Figure 23B:
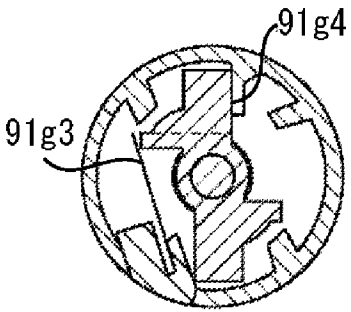
Figure 23C:
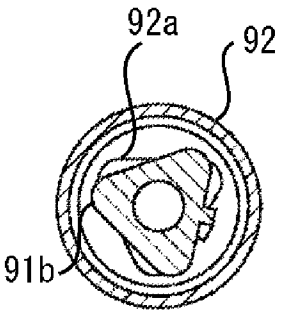

Next, an example of a state where the open/close door 102 is opened and the connection of the drive coupling 91 and the driven coupling 92 is released will be described. FIG. 23A is a sectional view of an example of the drive coupling 91 and the driven coupling 92 in a released state taken along the longitudinal direction. FIG. 23B is a sectional view taken along line Sc-Sc in FIG. 23A. Further, FIG. 23C is a sectional view taken along line Sd-Sd in FIG. 23A. As illustrated in FIG. 23A, when the open/close door 102 is opened, a flange portion 91*d* is pressed, and accordingly the release member 146 moves in the direction indicated by the arrow J despite the force applied by the spring 91*f*. According to this movement, the drive coupling 91 moves to a position where the drive coupling 91 is disconnected from the driven coupling 92. At this time, as illustrated in FIG. 23B, by the leaf spring 91*g*3 provided in the cap 91*g*, the cap 91*g* rotates in a counterclockwise direction until a rib 91*g*4 in the cap 91*g* contacts the intermediate part 91*e*. As illustrated in the example shown in FIG. 23C, the rotation angle of the cap 91*g* may be such that the protrusion 91*b* does not fit in the notch 92*b*. The configuration according to the present exemplary embodiment is designed such that when the open/close door 102 is opened, the connection of the main-body coupling 81 to the drum coupling 82, as well as the connection of the drive coupling 91 to the driven coupling 92, is released. Further, the configuration is mechanically designed such that when the open/close door 102 is closed, the drive coupling 91 is connected to the driven coupling 92 after the main-body coupling 81 is connected to the drum coupling 82.

With this configuration, the photosensitive drum 1*a* may rotate before the rotation of the intermediate transfer belt 13 is started without exception. According to the present exemplary embodiment, although the photosensitive drum 1*a* slides over the intermediate transfer belt 13 which is in a stop state, the damage of the photosensitive drum 1*a* will be smaller compared to when the intermediate transfer belt 13 slides over the photosensitive drum 1*a* which is in a stop state. This is because, if the intermediate transfer belt 13 slides over the photosensitive drum 1*a* in a stopped state, a particular portion of the photosensitive drum 1*a* will intensively receive friction contact. However, if the photosensitive drum 1*a* slides over the intermediate transfer belt 13 in a stop state, the whole circumference of the photosensitive drum 1*a* will receive the friction, and thus the damage will be smaller.

According to the present exemplary embodiment, the photosensitive drum 1*a* will rotate before the intermediate transfer belt 13 starts rotating as is with the first exemplary embodiment.

Figure 24:
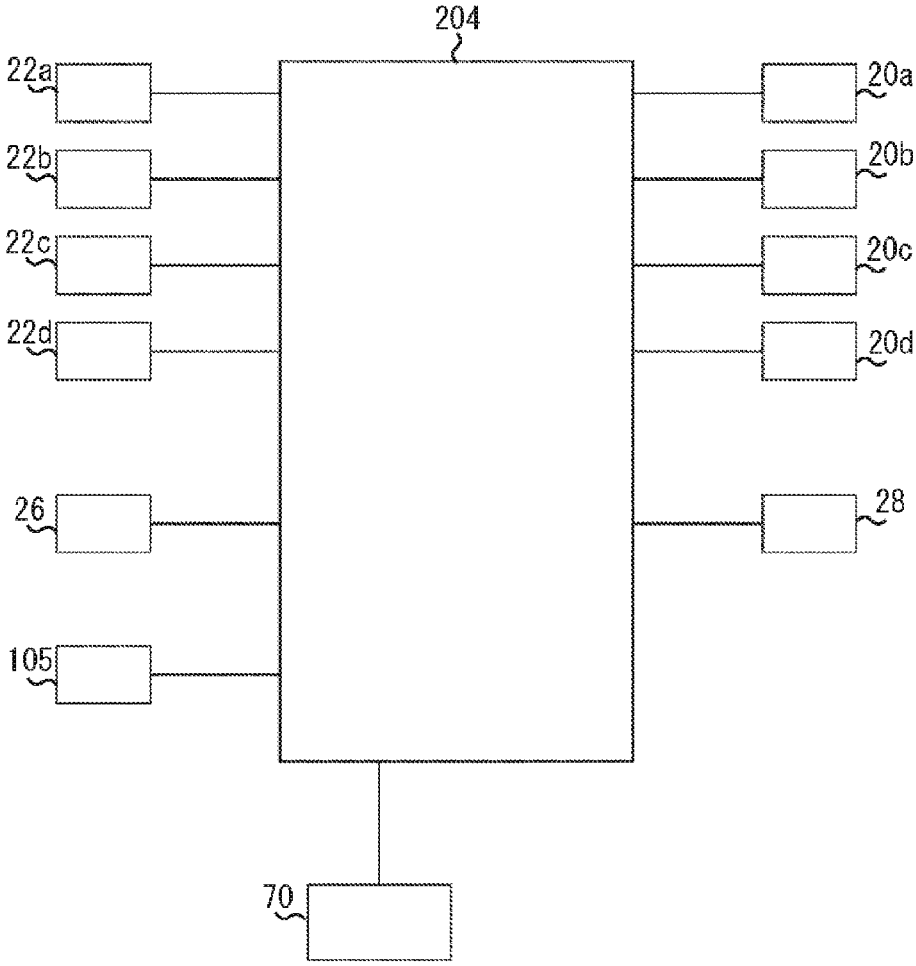
FIG. 24 illustrates an example of a block diagram of a control unit according to the second exemplary embodiment of the present invention.

As illustrated in the block diagram shown in the example of FIG. 24, a controller 204 as a control unit according to the present exemplary embodiment is electrically connected to the charge bias power supply units 20*a* to 20*d*, the primary transfer bias power supply units 22*a* to 22*d*, the secondary transfer bias power supply unit 26, the toner charge bias power supply unit 28, the motor 70, and the sensor 105 configured to detect whether the open/close door 102 is opened. Thus, according to the present exemplary embodiment, bias voltage is not applied to the primary transfer rollers 10*a* to 10*d* during the connection time, which is the time for the connection of the drive coupling 91 and the driven coupling 92, after the motor 70 is started. That is, the controller 204 drives the motor 70 so that the drive coupling 91 is moved to the engagement position, and after a driving force of the motor 70 is transmitted to the driven coupling 92, the controller 204 controls each of the primary transfer bias power supply units 22*a* to 22*d* as a voltage application unit so that the voltage is applied to each of the transfer rollers 10*a* to 10*d*.

Details of the control will now be described referring to the examples shown in FIGS. 12A and 12B. If the power supply of the image forming apparatus 100 is turned on, or if the open/close door 102 is closed from an open state, the controller 204 performs the preparation operation for receiving a print signal for starting the image forming operation of the image forming apparatus 100. For example, the resistance value of each of the intermediate transfer belt 13, the transfer rollers 10*a* to 10*d*, the charging rollers 2*a* to 2*d* may vary depending on an environment in which the image forming apparatus 100 is used. Thus, an optimum bias voltage to be applied to the transfer rollers 10*a* to 10*d* and the charging rollers 2*a* to 2*d* may be determined in this preparation operation. It is to be noted that "the state in which the power supply of the image forming apparatus 100 is turned on" is a state where the charge bias power supply units 20*a* to 20*d*, the primary transfer bias power supply units 22*a* to 22*d*, the secondary transfer bias power supply unit 26, and the toner charge bias power supply unit 28 are electrically connected to a commercial power source. Further, the open/close door 102 may typically be opened, for example, when any of the process cartridges 9*a* to 9*d* is removed, the belt unit 103 including the intermediate transfer belt 13 is replaced, or paper jam is cleared.

According to this example, the controller 204 outputs a signal for starting the motor 70 a time Tm after the power is turned on or the open/close door 102 is closed. Further the controller 104 outputs signals for starting application of voltage to the primary transfer bias power supply units 22*a* to 22*d* to start applying voltages to the primary transfer rollers 10*a* to 10*d* a time Td after the signal for starting the motor 70 is output. Here, the time Td comes after a maximum connection time Tc, which is a maximum time for connecting the drive coupling 91 to the driven coupling 92, has passed.

According to the present exemplary embodiment, the maximum connection time Tc is the time for the drive coupling 91 to rotate approximately 360 degrees at the maximum, since the raised portion 81*a* fits into the recessed portion 82*a* at a phase angle of 360 degrees. If the process speed Vps (mm/sec) is defined using the middle point of the thickness of the intermediate transfer belt 13, since the outer diameter of the drive roller 14 of the present exemplary embodiment is 20 mm, T equals to or greater than $1000\times360/360\times(20\pi+50/1000)/Vps$ (msec). Further, the motor 70 is stopped and the voltage application to the primary transfer rollers 10*a* to 10*d* is stopped at a time Ts after the application of the voltage to the primary transfer rollers 10*a* to 10*d* is started. Then, the controller 204 enters into a print signal waiting state and waits until it receives the print signal used for image forming.

Figure 12A:
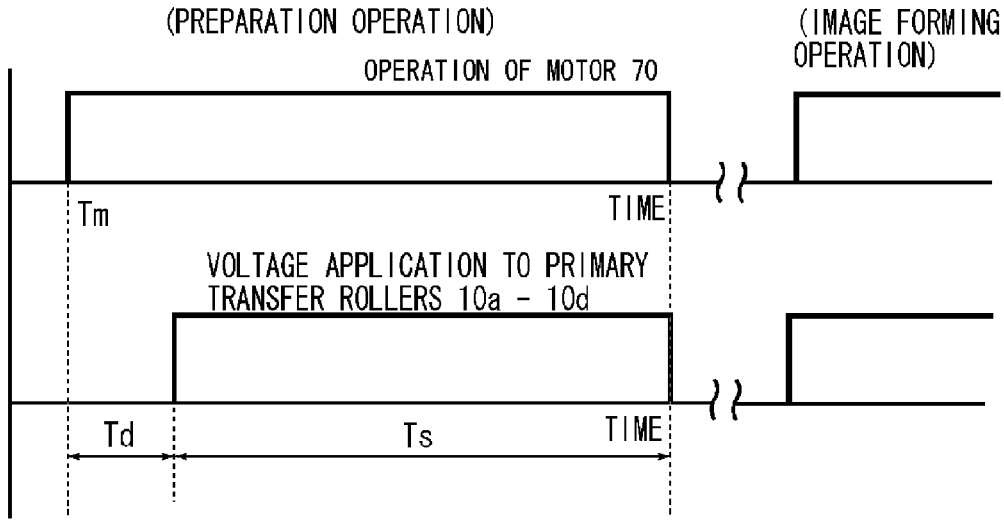
FIGS. 12A and 12B illustrate an example of voltage application timing according to the second exemplary embodiment of the present invention.
Figure 12B:
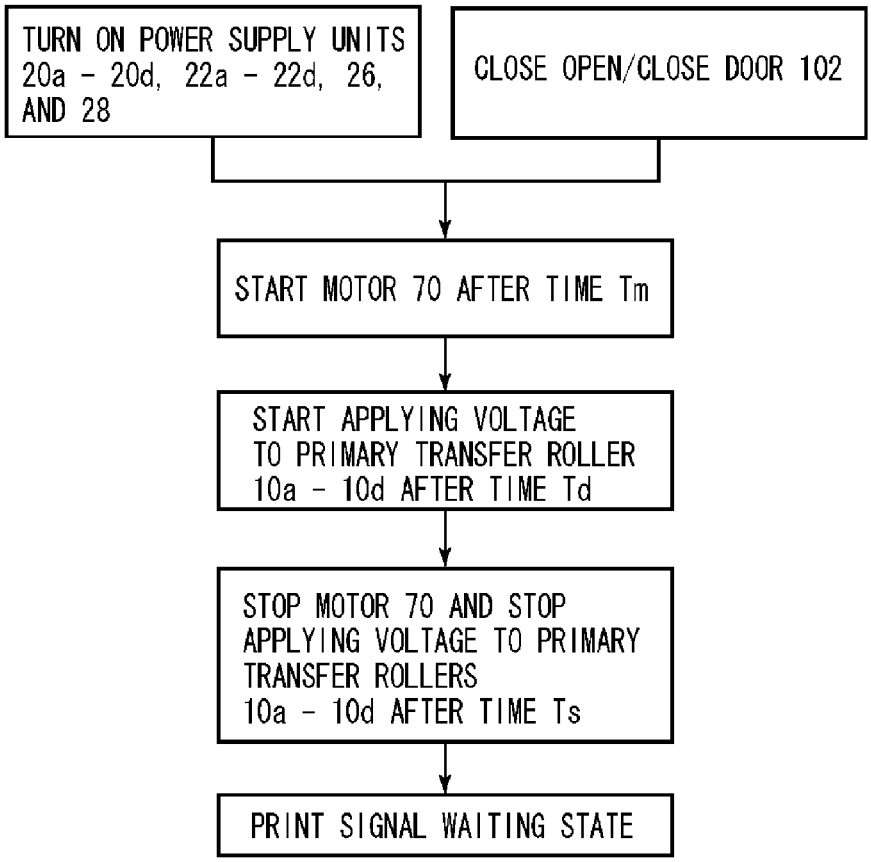

According to the configuration of the present exemplary embodiment, as illustrated in the examples shown in FIGS. 12A and 12B, when the open/close door 102 is closed or the power is turned on, a force is applied to the drum coupling 82 provided on one end of each of the photosensitive drums 1*a* to 1*d* from the main-body coupling 81 by the spring 144. However, as illustrated in FIG. 18, since the raised portion 81*a* and the recessed portion 82*a* are triangular in section, if the phase angles do not match, the main-body coupling 81 is not connected to the drum coupling 82.

The main-body coupling 81 rotates 120 degrees at the maximum before it is connected to the drum coupling 82. On the other hand, the driven coupling 92 provided on the drive roller 14 is not connected to the driven coupling 92 unless the drive coupling 91 rotates approximately 360 degrees if the open/close door 102 is closed or the power is turned on. This means that each of the photosensitive drums 1*a* to 1*d* starts rotating prior to the intermediate transfer belt 13. Thus, at that time, the timing of voltage application to each of the primary transfer rollers 10*a* to 10*d* will be delayed. In this way, the intermediate transfer belt 13 can be prevented from being attracted to the photosensitive drums 1*a* to 1*d* due to the electrostatic attraction force that is generated by the electric potential difference between the surface of each of the photosensitive drums 1*a* to 1*d* and the intermediate transfer belt 13. Since the intermediate transfer belt 13 is not attracted, and since the drive roller 14 is not affected by the rotation of the intermediate transfer belt 13, the drive coupling 91 is connected to the driven coupling 92 before the drive coupling 91 rotates 360 degrees at the maximum.

Since the driven coupling 92 and the drive coupling 91 can be relatively securely connected in the above-described preparation operation, throughput of the image forming operation can be improved. Further, since the image forming operation may be started based on the securely-connected couplings, the generation of defective images due to poor connection of the couplings may be prevented.

Figure 26A:
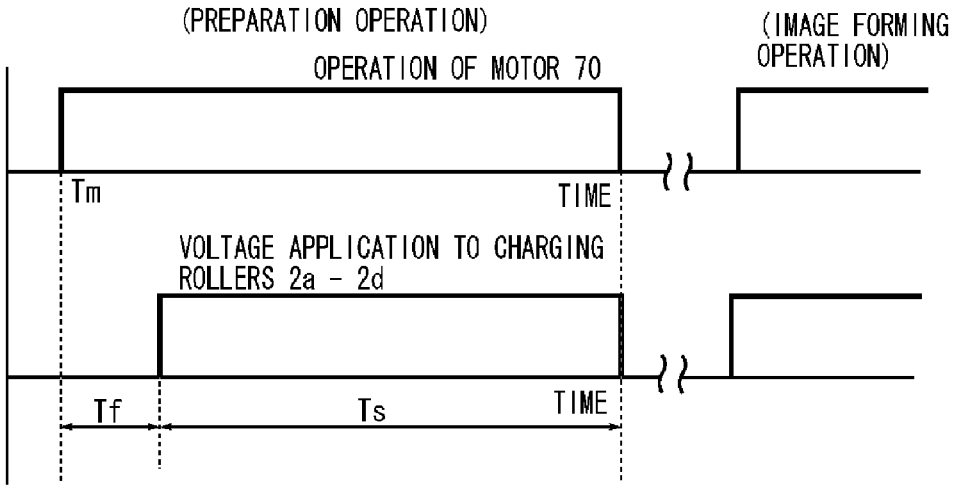
FIGS. 26A and 26B illustrate an example of voltage application timing according to the second exemplary embodiment of the present invention.
Figure 26B:
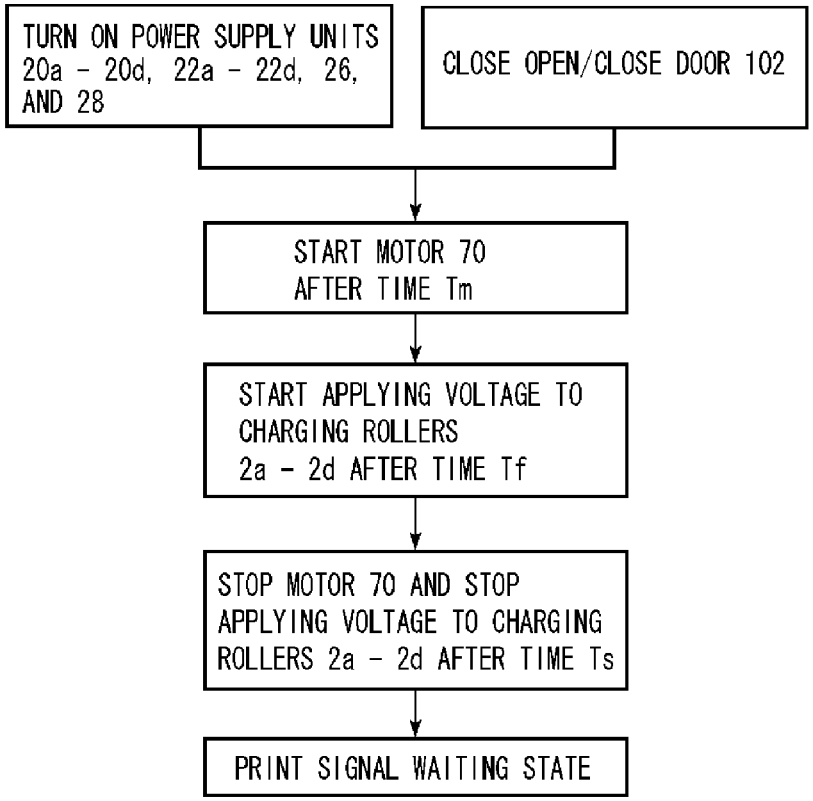

Since the voltage application to the primary transfer roller 10*a* from the primary transfer bias power supply unit 22*a* has been described above, now, timing of voltage application to the charging roller 2*a* will be described referring to the examples shown in FIGS. 26A and 26B. If a voltage is applied to the charging roller 2*a* at the same time the signal used for starting the motor 70 is output, the portion of the photosensitive drum 1*a* that has been charged by the charging roller 2*a* reaches a position where the photosensitive drum 1*a* contacts the intermediate transfer belt 13 at a predetermined time Te earlier. At this time, by the electrostatic attraction force that is generated by the electric potential difference between the photosensitive drum 1*a* and the intermediate transfer belt 13, the intermediate transfer belt 13 may be attracted to the photosensitive drum 1*a*. In order to prevent this from occurring, the voltage application to the charging roller 2*a* may be started after the signal used for starting the motor 70 is output. In this way, the intermediate transfer belt 13 can be prevented from being attracted to the photosensitive drum 1*a*.

That is, according to this example, voltage application to the primary transfer roller 10*a* by the primary transfer bias power supply unit 22*a* may not be started until the driven coupling 92 and the drive coupling 91 are connected after the motor 70 is started. However, if a voltage is applied to the charging roller 2*a* by the charge bias power supply unit 20*a*, the portion of the photosensitive drum 1*a* that has been charged by the charging roller 2*a* takes the time Te to reach the position where the photosensitive drum 1*a* contacts the intermediate transfer belt 13. This means that timing Tf, which is the time the voltage application to the charging roller 2*a* is started after the signals for starting the motor 70 is output, is set so that it comes after the time obtained by subtracting the time Te from the time Tc, which is a maximum connection time of the driven coupling 92 and the drive coupling 91, has passed after the start of the motors. Further, the controller 204 may control the charge bias power supply unit 20*a* to start applying a voltage to the charge roller 2*a* so that the portion of the photosensitive drum 1*a* charged by the charge roller 2*a* does not reach the position where the portion contacts the intermediate transfer belt 13 until the driving force is transmitted to the driven coupling 92 after the motor 70 is started. In other words, the controller 204 drives the motor 70 so that the drive coupling 91 is moved to the engagement position, and controls the charge bias power supply unit 20*a* to apply a voltage to the charging roller 2*a* so that a portion of the photosensitive drum 1*a* charged by the charging roller 2*a* reaches the position where the portion contacts the intermediate transfer belt 13 after the driving force is transmitted to the driven coupling 92 by the driving force of the motor 70.

It is to be noted that the above-described control may be performed when the power is turned on since the open/close door 102 can be opened and closed while the power is turned off.

According to the present exemplary embodiment, a voltage is applied to the charging roller 2 or the primary transfer roller 10 a certain time after the signal for starting the motor 70 is output. However, the voltage can be applied to both the charging roller 2 and the primary transfer roller 10 a certain time after the signal for starting the motor 70 is output.

According to the first and the second exemplary embodiments, the image forming apparatus 100 including the intermediate transfer belt 13 to which a toner image on the photosensitive drum 1 is directly transferred to form a superimposed image has been described.

According to exemplary embodiments of the invention, an image forming apparatus may be provided having a relatively simple configuration used for enabling fairly secured connection of a coupling provided on a photosensitive member or a drive member for or a belt to a coupling provided on a main body of the image forming apparatus. Aspects according to the present invention may provide an image forming apparatus capable of inhibiting and even preventing defective images due to connection failure of the couplings.

Figure 13:
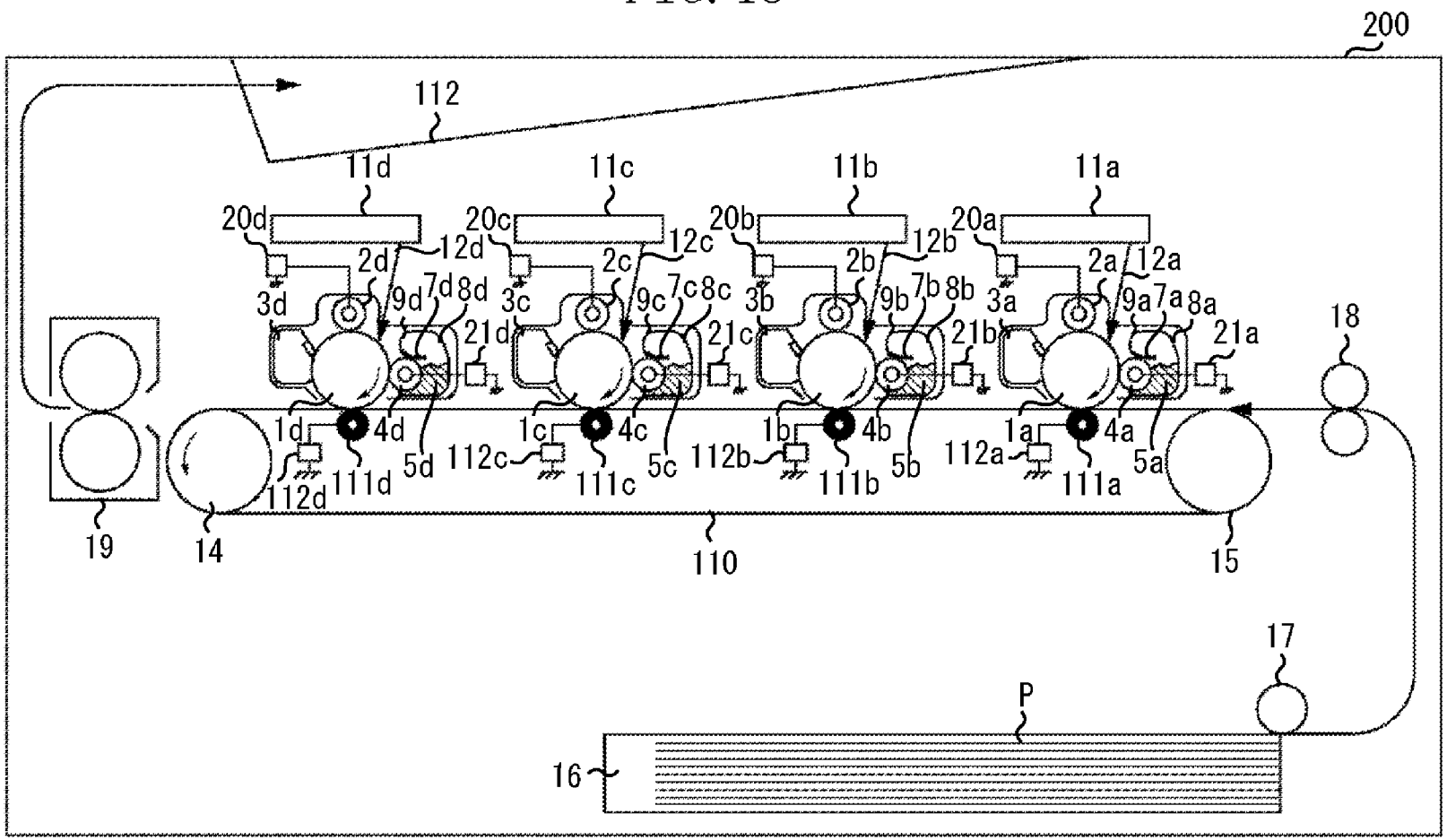
FIG. 13 illustrates an example of an image forming apparatus according to another exemplary embodiment of the present invention.

According to another exemplary embodiment of the present invention, as illustrated in the example shown in FIG. 13, an image forming apparatus 200 includes a conveying belt 110 used for carrying and conveying paper as a recording medium in place of an intermediate transfer belt. According to the present exemplary embodiment, when voltages from power sources 112*a* to 112*d* are applied to primary transfer rollers 11*a* to 111*d*, respectively, toner images formed on the respective photosensitive drums 1*a* to 1*d* may be directly multi-layer transferred onto a recording medium conveyed by the conveying belt 110. Thus, the secondary transfer roller 25, the secondary transfer counter roller 24, and the secondary transfer bias power supply unit 26 may not be included in the present exemplary embodiment. Other configurations may be similar to those of the second exemplary embodiment.

As describe above, according to an exemplary embodiment of the present invention, a voltage is applied to the transfer member after the drive of the motor is started and the driving force is transmitted to the couplings. Further, a voltage is applied to the charging member so that a portion of the photoreceptor charged by the charging member is moved to the position where that portion contacts the belt after the drive of the motor is started and the driving force is transmitted to the couplings. Accordingly, the belt can be prevented from being attracted to the photosensitive member due to electrostatic attraction force that is generated between the surface of the photosensitive member and the belt. Further, since the driven coupling and the drive coupling can be relatively securely connected, it may be possible to prevent defective images due to poor connection of the couplings. Further, by performing the control in the preparation operation, enhanced throughput considering image forming can be achieved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An image forming apparatus for forming an image on a recording medium, the image forming apparatus comprising:

a photosensitive member configured to carry a toner image;

a rotatable motor;

a drive transmission device to which a driving force is transmitted from the rotatable motor;

a driven transmission device configured to engage with the drive transmission device and transmit the driving force from the drive transmission device to the photosensitive member;

a belt configured to contact the photosensitive member;

a drive roller configured to rotate the belt;

a driven coupling configured to transmit the driving force to the drive roller;

a drive coupling configured to come into engagement with the driven coupling and transmit the driving force to the driven coupling;

a transfer member configured to transfer the toner image formed on the photosensitive member onto the recording medium carried on the belt or onto the belt;

a voltage application unit configured to apply a voltage to the transfer member; and a control unit configured to control the voltage application unit and the rotatable motor, wherein when the voltage application unit applies a voltage to the transfer member before the engagement of the drive coupling with the driven coupling is completed and rotation of the belt has initiated, the belt is electrostatically attracted to the photosensitive member and follows a rotation movement of the photosensitive member, wherein the control unit starts to apply the voltage to the transfer member when a predetermined time period passes after the rotatable motor starts to rotate, the predetermined time period set to be longer than a 'maximum' time period from a time when the drive coupling starts to rotate to a time when the drive coupling comes into engagement with the driven coupling.

2. The image forming apparatus according to claim 1, wherein one of the drive coupling and the driven coupling includes a triangular protrusion section and the other includes a triangular hole section, into which the triangular protrusion is fittable.

3. The image forming apparatus according to claim 2, wherein the protrusion is twisted in an axial direction of the protrusion.

4. The image forming apparatus according to claim 2, wherein the hole is twisted in an axial direction of the hole.

5. The image forming apparatus according to claim 1, further comprising:

an opening provided in a main body of the image forming apparatus; and an open/close door configured to take a closed state where the opening is closed and an open state where the opening is open, wherein the drive coupling is movable in the axial direction of the drive coupling in conjunction with an open/close operation of the open/close door, such that the drive coupling takes an engagement position when the open/close door is in the closed state and takes a release position when the open/close door is in the open state.

6. The image forming apparatus according to claim 5, wherein when the open/close door is changed to the closed state from the open state, the control unit rotates the rotatable motor.

7. The image forming apparatus according to claim 5, wherein the control unit rotates the rotatable motor when a power supply unit provided in the image forming apparatus is turned on.

8. An image forming apparatus for forming an image on a recording medium, the image forming apparatus comprising:

a photosensitive member configured to carry a toner image;

a charging member configured to charge the photosensitive member;

a rotatable motor;

a drive transmission device to which a driving force is transmitted from the rotatable motor;

a driven transmission device configured to come into engagement with the drive transmission device and transmit the driving force from the drive transmission device to the photosensitive member;

a belt configured to contact the photosensitive member;

a drive roller configured to rotate the belt;

a driven coupling configured to transmit the driving force to the drive roller;

a drive coupling configured to engage with the driven coupling and transmit the driving force to the driven coupling;

a voltage application unit configured to apply a voltage to the charging member;

a control unit configured to control the voltage application unit and the rotatable motor, wherein when the voltage application unit applies a voltage to the charging member before the engagement of the drive coupling with the driven coupling is completed and rotation of the belt has initiated, the belt is electrostatically attracted to the charged photosensitive member and follows a rotation movement of the photosensitive member, wherein the control unit starts to apply the voltage to the transfer member when a predetermined time period passes after the rotatable motor starts to rotate, the predetermined time period set to be longer than a time period calculated by subtracting a 'charge' time period from a 'maximum' time period, the 'charge' time period from when the photosensitive member is charged by the charging member to a time when a charged portion of the photosensitive member reaches a position where the charged portion contacts the belt, and the 'maximum' time period from a time when the drive coupling starts to rotate to a time when the drive coupling comes into engagement with the driven coupling.

9. The image forming apparatus according to claim 8, wherein one of the drive coupling and the driven coupling includes a triangular protrusion section and the other includes a triangular hole section, into which the triangular protrusion is fittable.

10. The image forming apparatus according to claim 9, wherein the protrusion is twisted in an axial direction of the protrusion.

11. The image forming apparatus according to claim 9, wherein the hole is twisted in an axial direction of the hole.

12. The image forming apparatus according to claim 8, further comprising:

an opening provided in a main body of the image forming apparatus; and an open/close door configured to take a closed state where the opening is closed and an open state where the opening is open, wherein the drive coupling is movable in the axial direction of the drive coupling in conjunction with an open/close operation of the open/close door, such that the drive coupling takes an engagement position when the open/close door is in the closed state and takes a release position when the open/close door is in the open state.

13. The image forming apparatus according to claim 12, wherein when the open/close door is changed to the closed state from the open state, the control unit rotates the rotatable motor.

14. The image forming apparatus according to claim 12, wherein the control unit rotates the rotatable motor when a power supply unit provided in the image forming apparatus is turned on.

15. The image forming apparatus according to claim 1, wherein the drive transmission device and the driven transmission device are spur gears.

16. The image forming apparatus according to claim 1, wherein the drive transmission device is a main-body coupling and the driven transmission device is a drum coupling configured to come into engagement with the main-body coupling at a predetermined phase angle and transmit the driving force to the photosensitive member.

17. The image forming apparatus according to claim 1, wherein the rotatable motor is a common motor configured to transmit the driving force to the drive coupling.

18. The image forming apparatus according to claim 8, wherein the drive transmission device and the driven transmission device are spur gears.

19. The image forming apparatus according to claim 8, wherein the drive transmission device is a main-body coupling and the driven transmission device is a drum coupling configured to come into engagement with the main-body coupling at a predetermined phase angle and transmit the driving force to the photosensitive member.

20. The image forming apparatus according to claim 8, wherein the rotatable motor is a common motor configured to transmit the driving force to the drive coupling.

* * * * *